US012172067B2

(12) United States Patent
Desrumaux et al.

(10) Patent No.: US 12,172,067 B2
(45) Date of Patent: Dec. 24, 2024

(54) SYSTEM AND METHOD FOR PROVIDING A FITNESS EXPERIENCE TO A USER

(71) Applicant: BoxCo SAS, Paris (FR)

(72) Inventors: Léo Desrumaux, Paris (FR); Nicolas de Maubeuge, Vanves (FR); Evans Perret, Saint-Etienne (FR); Thomas Xie, Saint-Jean Bonnefonds (FR)

(73) Assignee: BoxCo SAS, Paris (FR)

( * ) Notice: Subject to any disclaimer, the term of this patent is extended or adjusted under 35 U.S.C. 154(b) by 0 days.

(21) Appl. No.: 18/639,756

(22) Filed: Apr. 18, 2024

(65) Prior Publication Data

US 2024/0342579 A1 Oct. 17, 2024

Related U.S. Application Data

(63) Continuation of application No. PCT/IB2022/060587, filed on Nov. 3, 2022.

(30) Foreign Application Priority Data

Nov. 3, 2021 (EP) ..... 21306543

(51) Int. Cl.
*A63B 71/06* (2006.01)
*A63B 24/00* (2006.01)
(Continued)

(52) U.S. Cl.
CPC ..... *A63B 71/0622* (2013.01); *A63B 24/0062* (2013.01); *A63B 69/222* (2022.08);
(Continued)

(58) Field of Classification Search
CPC . A63B 24/0062; A63B 69/222; A63B 69/322; A63B 71/0622; A63B 2024/0096;
(Continued)

(56) References Cited

U.S. PATENT DOCUMENTS 8,079,938 B2 * 12/2011 Jones ..... A63B 69/32 482/84
8,419,436 B2 4/2013 Perez
(Continued)

FOREIGN PATENT DOCUMENTS

AU 2018233536 11/2021
CA 3032619 4/2021
(Continued)

OTHER PUBLICATIONS

Bhout Boxking Club. https://web.archive.org/web/20220721084630/https://www.bhout.com/. Jul. 21, 2022.

*Primary Examiner* — Joshua Lee
(74) *Attorney, Agent, or Firm* — Van Pelt, Yi & James LLP

(57) ABSTRACT

Methods and systems for providing a fitness experience to a user. The system comprises a punching bag defining an outer non-planar surface adapted to receive strikes of the user, a sensor configured to generate data about strikes applied by the user on the punching bag, an image projecting device configured to project a dynamic content on the outer non-planar surface of the punching bag and processor communicably connected to the sensor and the image projecting device. The processor is configured to dynamically adjust the dynamic content projected on the outer non-planar surface based at least in part on data provided by the sensor.

30 Claims, 21 Drawing Sheets

(51) Int. Cl.
*A63B 69/22* (2006.01)
*A63B 69/32* (2006.01)

(52) U.S. Cl.
CPC .... *A63B 69/322* (2022.08); *A63B 2024/0096* (2013.01); *A63B 2220/53* (2013.01); *A63B 2220/805* (2013.01); *A63B 2225/74* (2020.08)

(58) Field of Classification Search
CPC ..... A63B 2220/53; A63B 2220/805; A63B 2225/74
See application file for complete search history.

(56) References Cited

U.S. PATENT DOCUMENTS

| | | | | |
|---|---|---|---|---|
| 9,021,857 | B1 | 5/2015 | Squire | |
| 9,027,415 | B2 | 5/2015 | Tsai | |
| 9,061,194 | B2 | 6/2015 | Iglehart | |
| 9,084,924 | B2 | 7/2015 | Jones | |
| 9,101,791 | B2 | 8/2015 | Boyette | |
| 9,174,108 | B2 | 11/2015 | Siklosi | |
| 9,227,128 | B1 | 1/2016 | Carfagna, Jr. | |
| 9,414,649 | B1 | 8/2016 | Siklosi | |
| 9,511,262 | B1 | 12/2016 | Depompe | |
| 9,517,384 | B2 | 12/2016 | Le | |
| 9,566,508 | B2 | 2/2017 | Cheng | |
| 9,586,120 | B1 | 3/2017 | Sotelo | |
| 9,782,652 | B2 | 10/2017 | Williamson | |
| 9,884,238 | B2 | 2/2018 | Tsai | |
| 9,943,742 | B2 * | 4/2018 | Burt, Jr. | A63B 69/322 |
| 10,213,672 | B2 * | 2/2019 | Codrington | B32B 5/18 |
| 10,449,416 | B2 | 10/2019 | Dalebout | |
| 10,500,473 | B2 | 12/2019 | Watterson | |
| 10,589,159 | B2 | 3/2020 | Pajonk-Taylor | |
| 10,639,521 | B2 | 5/2020 | Foley | |
| 11,040,247 | B2 | 6/2021 | Casalini | |
| 11,130,037 | B2 | 9/2021 | Wu | |
| 11,145,399 | B2 | 10/2021 | Foley | |
| 11,202,951 | B1 | 12/2021 | Augustin | |
| 11,231,771 | B2 | 1/2022 | Morin | |
| 11,253,765 | B1 | 2/2022 | Huang | |
| 11,291,900 | B2 | 4/2022 | Allred | |
| 11,298,578 | B2 | 4/2022 | Ward | |
| 11,311,778 | B2 | 4/2022 | Ward | |
| 11,338,190 | B2 | 5/2022 | Evancha | |
| 11,344,786 | B2 | 5/2022 | Intonato | |
| 11,369,843 | B2 | 6/2022 | Forkosh | |
| 11,383,134 | B2 | 7/2022 | Intonato | |
| 11,395,950 | B2 | 7/2022 | Jones | |
| 11,397,558 | B2 | 7/2022 | Mukherjee | |
| 11,426,643 | B2 * | 8/2022 | Duffy | A63B 69/22 |
| 2005/0181913 | A1 | 8/2005 | Vang | |
| 2005/0288159 | A1 | 12/2005 | Tackett | |
| 2011/0130183 | A1 * | 6/2011 | Pelletter | A63F 13/833 463/7 |
| 2011/0172060 | A1 | 7/2011 | Morales | |
| 2015/0375079 | A1 * | 12/2015 | Wood | A63B 71/0622 482/8 |
| 2016/0074734 | A1 * | 3/2016 | Tsai | A63B 24/0062 482/8 |
| 2016/0148536 | A1 | 5/2016 | Ashby | |
| 2018/0178103 | A1 * | 6/2018 | Zhang | A63B 69/32 |
| 2019/0290964 | A1 | 9/2019 | Oren | |
| 2019/0388760 | A1 * | 12/2019 | Morin | A63B 69/32 |
| 2020/0306609 | A1 | 10/2020 | Wu | |
| 2021/0008413 | A1 | 1/2021 | Asikainen | |
| 2021/0106896 | A1 | 4/2021 | Fountaine | |
| 2021/0146197 | A1 | 5/2021 | Packles | |
| 2021/0291013 | A1 | 9/2021 | Nascimento | |
| 2021/0299520 | A1 | 9/2021 | Evancha | |
| 2021/0316202 | A1 | 10/2021 | Zillich | |
| 2021/0387073 | A1 | 12/2021 | Casalini | |
| 2021/0394011 | A1 | 12/2021 | Neuhaus | |
| 2022/0016508 | A1 | 1/2022 | Baer | |
| 2022/0023739 | A1 | 1/2022 | Degooyer | |
| 2022/0054925 | A1 | 2/2022 | Chiang | |
| 2022/0062738 | A1 | 3/2022 | Neuhaus | |
| 2022/0088440 | A1 | 3/2022 | Jaic | |
| 2022/0134204 | A1 | 5/2022 | Raco | |
| 2022/0143466 | A1 | 5/2022 | Zoffoli | |
| 2022/0148273 | A1 | 5/2022 | Morin | |
| 2022/0168621 | A1 | 6/2022 | D'Alesio | |
| 2022/0176223 | A1 | 6/2022 | Zittel | |
| 2022/0176226 | A1 | 6/2022 | Giudici | |
| 2022/0184456 | A1 | 6/2022 | Hen | |
| 2022/0184480 | A1 | 6/2022 | Morin | |
| 2022/0223254 | A1 | 7/2022 | Foley | |
| 2022/0233938 | A1 | 7/2022 | Morin | |
| 2022/0249934 | A1 | 8/2022 | Augustin | |
| 2022/0280858 | A1 | 9/2022 | Intonato | |

FOREIGN PATENT DOCUMENTS

| | | |
|---|---|---|
| EP | 3426361 | 9/2021 |
| EP | 3922325 | 12/2021 |
| EP | 3570211 | 3/2022 |
| ES | 2742573 | 2/2020 |
| FI | 20185961 | 5/2020 |
| GB | 2593489 | 9/2021 |
| JP | 3236932 | 3/2022 |
| TW | 1757953 | 3/2022 |
| WO | 2004070336 | 8/2004 |
| WO | 2012137231 | 10/2012 |
| WO | 2020197779 | 10/2020 |
| WO | 2021165908 | 8/2021 |
| WO | 2021171039 | 9/2021 |

* cited by examiner

SYSTEM AND METHOD FOR PROVIDING A FITNESS EXPERIENCE TO A USER

CROSS REFERENCE TO OTHER APPLICATIONS

This application is a continuation of and claims priority to International (PCT) Application No. PCT/IB22/60587 entitled SYSTEM AND METHOD FOR PROVIDING A FITNESS EXPERIENCE TO A USER, filed Nov. 3, 2022 which is incorporated herein by reference for all purposes, which claims priority to Europe application Ser. No. 21/306,543.6 entitled SYSTEM AND METHOD FOR PROVIDING A FITNESS EXPERIENCE TO A USER, filed Nov. 3, 2021 which is incorporated herein by reference for all purposes.

TECHNICAL FIELD

This application relates to the general field of connected fitness and, more particularly, to systems and methods for providing a fitness experience to a user.

BACKGROUND OF THE INVENTION

Fitness machines and tools for both commercial mass training experience and connected at-home based experience have recently gained traction.

However, fitness activities relying entirely on digital technologies lack the resistance- and equipment-feel of a traditional or connected fitness experience (bicycle, treadmill, rower, punching bag). There are activities which can be done in fitness without equipment (jumping, aerobics, yoga). There are other activities such as rowing, cycling and weight training which simply cannot be performed without a piece of equipment to provide the adequate amount of resistance to the training experience. In addition, a degree of immersion associated with digital fitness activities is oftentimes limited and constrained to a small form factor, for example, such as on the screen of a user's electronic device (mobile phone, laptop/tablet, TV). Moreover, current digital fitness technologies do not provide or utilize actual pieces of equipment used for the specific fitness activity, for example a bicycle for cycling training, thus precluding much of any immersive feeling for the user.

Even though the recent developments identified above may provide benefits, improvements are still desirable.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches.

SUMMARY

Implementations of the described technology enable a user to experience a resistance-based fitness experience with an unparalleled level of immersion, for example through the following features: 1) the display of a dynamic and interactive content onto the surface of the punching bag as well as secondary information including performance statistics, leaderboard, timing and visual guidance related to the workout undertaken by the user, 2) the ability for the user to interact physically (i.e. punch or strike) the punching bag with a life-size coach or any content projected onto the surface of the punching bag and 3) the ability for the user to receive personalized feedback.

Broadly speaking, the present technology provides systems and method for providing a fitness activity to a user with increased immersivity due to projection of dynamic content on a non-planar surface, said non-planar surface receiving strikes of the user. The combination of the dynamic content and sensors that may detect strikes and movements of the user allows the user to interact with the dynamic content which is dynamically adjusted based on the interactions of the user. The sensors may detect incoming strikes before said strikes actually come in contact with the punching bag Implementations of the described technology may include the projection of a coach in life-size form onto substantially the entire surface of the punching bag and the display of this life-size form image of the coach at substantially the center point of the bag as well as onto the edges of the bag (may exclude the extremities), allowing for the coach being projected to move for example left, right and center, as well as up and down, across the surface of the bag. The user may then follow for example the image of the coach, follow his/her movements left, right and center, replicate his/her technique and strikes.

Implementations of the described technology may give the user the ability to physically interact, feel, touch and punch the image of the coach, with minimal or no risk of damaging the electronic components, as they may be mechanically independent from the punching bag or located on portions of the punching bag that are not subjected to strikes of the user. The present technology aims at providing the user with an immersive feeling as the user would have when working out with a private fitness instructor or boxing coach in a physical one-on-one setting.

Implementations of the described technology may include a novel form factor for a punching bag, easy to integrate in an at-home environment while offering a stellar boxing experience and real-time feedback. The punching bag may be designed to facilitate its integration in the home through being, for example, a half-cylinder elliptical shape with a flat back surface. The punching bag form could either be a semi-cylinder (with varying radius) or a half-cylinder (with varying radius) with a varying degree of elliptical ratio. The elliptical ratio may be defined based on a ratio of the length of the shortest axis of the ellipse to the length of the longest axis of the ellipse (e.g. $e_1=1-L/L_L$, where $e_r$ is the elliptical ratio, $L_s$ is the length of the shortest axis of the ellipse and $L_L$ is the length of the longest axis of the ellipse). For example and without limitation, an elliptical ratio may be between 5% and 50%.

This flat back surface may allow for the punching bag to be easily mounted against the wall in one's home by using, for example, a wall-mounting frame. The wall-mounting frame may be designed to prevent the bag from excessively moving around or from tilting up-and-down when being struck, eliminating the noise and vibration typically generated when practicing on a traditional punching bag. The fixed nature of the punching bag also may eliminate the constant movement associated with traditional boxing bags when being struck, thereby allowing the user to not have to worry about the perpetual movement of the bag while he or she is striking the bag. Various shock and vibration absorbing or dampening techniques, such as, for example, springs and/or shock absorbers, sponge-like material with 'give' such as foam. or magnetic e-suspension, and so on, may be utilized by the system in for example, the wall mounting mechanism and may be packed into a vibration absorption module that may measure the total energy expended by the strikes of the user, and may add a more realistic feel to the bag with small movements at and just after the strike to simulate a coach holding the 'bag', and so on. Wall-mounting generally eliminates the need to fill a base with water or sand which is required by traditional freestanding punching bags.

Furthermore, implementations of the described technology may include the elliptical nature of the punching bag, which may also be designed to provide an efficient image projection of the coach across most or the entire surface of the bag. The elliptical curve may serve to flatten-out the edges of the punching bag allowing for an about complete and in-focus projection of a life-size image of the coach across the entire surface of the punching bag, from center to the left and right edges of the bag. As well, the elliptical curve may allow the bag to substantially retain its cylindrical, human-form shape, which is desirable for ensuring an efficient striking experience for the user.

Moreover, the shape and dimensions of the punching bag, as well as other factors which are also present in some implementations of the described technology, may also serve to provide au efficient boxing and striking experience for the user, allowing the user to for example: 1) Move about 150° degrees along the curve of the punching bag, and thus replicate a majority of movements associated with boxing, for example, such as moving right and left, shifting, ducking, rolling, pivoting, advancing, and retreating. 2) Carry out strikes in the same way a user would punch a traditional punching bag or punch boxing mitts held by a boxing coach, for example, such as jabs, straights, hooks, uppercuts, overhands (etc.) at both upper-body and lower-body levels. 3) The system may incorporate striking sensors capable of tracking exercise performance metrics of the user in real time, 4) The system may also incorporate motion tracking sensors, capable of capturing movements of the user, which may be utilized, for example, to check form, estimate strike power, estimate muscles/groups used, record workouts, multi-boxer uses, and so on. The striking sensors mentioned herein above may be able to determine a number, a location, a timing and a force or "power" of the strikes being thrown by the user and may be utilized to provide data to enable calculations of, for example, accuracy, timing, power, injury potential or rehabilitation uses, and so on.

In a first aspect, the present technology provides a system for providing a fitness experience to a user. The system comprises a punching bag defining an outer non-planar surface adapted to receive strikes of the user, a sensor configured to generate data about strikes applied by the user on the punching bag, an image projecting device configured to project a dynamic content on the outer non-planar surface of the punching bag and a processor communicably connected to the sensor and the image projecting device. The processor is configured to dynamically adjust the dynamic content projected on the outer non-planar surface based at least in part on data provided by the sensor.

In a second aspect, the present technology provides a method for determining setting characteristics of a plurality of sensors configured for determining localization of strikes of a user on an outer non-planar surface of a punching bag. The method comprises identifying a critical portion of the outer non-planar surface and a critical corresponding 3D zone of interest, accessing information about 3D geometry of the outer non-planar surface, accessing information about candidate positions for the plurality of sensors, accessing an input precision criterion indicative of a maximal distance between an estimated position of a strike determined by the plurality of sensors and an actual position of the strike on the critical corresponding 3D zone of interest and determining setting characteristics of the plurality of sensors based on the input precision criterion, the 3D geometry of the outer non-planar surface, and electromechanical characteristics of the plurality of sensors.

In a third aspect, the present technology provides a system for characterizing strikes of a user. The system comprises a punching bag defining an outer surface adapted to receive strikes of the user, a sensor having a corresponding field-of-view, the sensor being configured to generate data about the strikes of the user on the outer surface of the punching bag, the sensor generating the data about the strikes in a contactless manner with respect to the strikes and a processor communicably connected to the sensor and configured to generate a content based on data provided by the sensor.

In a fourth aspect, the present technology provides a method for executing a sensor calibration procedure of a system comprising a punching bag defining an outer surface adapted to receive strikes of a user, a sensor configured to generate data about a strike of the user on the outer surface of the punching bag, and an imaging projecting device configured to project a content on the outer surface of the punching bag, the method being executed by a processor communicably connected to the sensor and the imaging projecting device. The method comprises displaying, using the image projecting device, one or more items at pre-determined locations on the outer surface, the one or more items being provided to the user with indications leading the user to apply strike on the outer surface at the pre-determined locations of the one or more items. The method also comprises determining, using the sensor, present locations of strikes applied by the user in response to the displaying of the one or more items, determining an error-correction parameter of the sensor by comparing the pre-determined locations of the one or more items with the present locations of the applied strikes and adjusting a calibration of the sensor based on the error-correction parameter.

In a fifth aspect, the present technology provides a system for providing a fitness experience to a user. The system comprises a punching bag defining an outer non-planar surface, an image projecting device configured to project a content on the outer non-planar surface of the punching bag and a processor communicably connected to the image projecting device, the processor being configured to perform an image distortion correction to the content.

In a sixth aspect, the present technology provides a punching bag for providing a fitness experience to a user, the punching bag defining an outer surface, the punching bag having an elliptical shape on at least a portion of the outer surface and defining a flat back surface on another portion of the outer surface configured to be maintained against a wall of a building.

In a seventh aspect, the present technology provides a system for providing an interactive fitness experience to a user. The system comprises a punching bag defining an outer surface adapted to receive a strike of the user, an image projecting device configured to project an interactive content on the outer surface of the punching bag, a sensor configured to generate data comprising information about at least one of a location of the strike on the outer surface of the punching bag, a speed of the strike, an acceleration of the strike, a trajectory of the strike, and/or a force of the strike. The system further comprises a processor communicably connected to the image projecting device and the sensor, the processor being configured to receive, from the sensor, indication of an interaction of the user with the interactive content and dynamically adjust the interactive content projected on the outer surface based at least in part on the data provided by the sensor.

BRIEF DESCRIPTION OF THE DRA WINGS

Various implementations of the technology will be understood and appreciated more fully from the following detailed description, taken in conjunction with the drawings in which.

Figure 1:
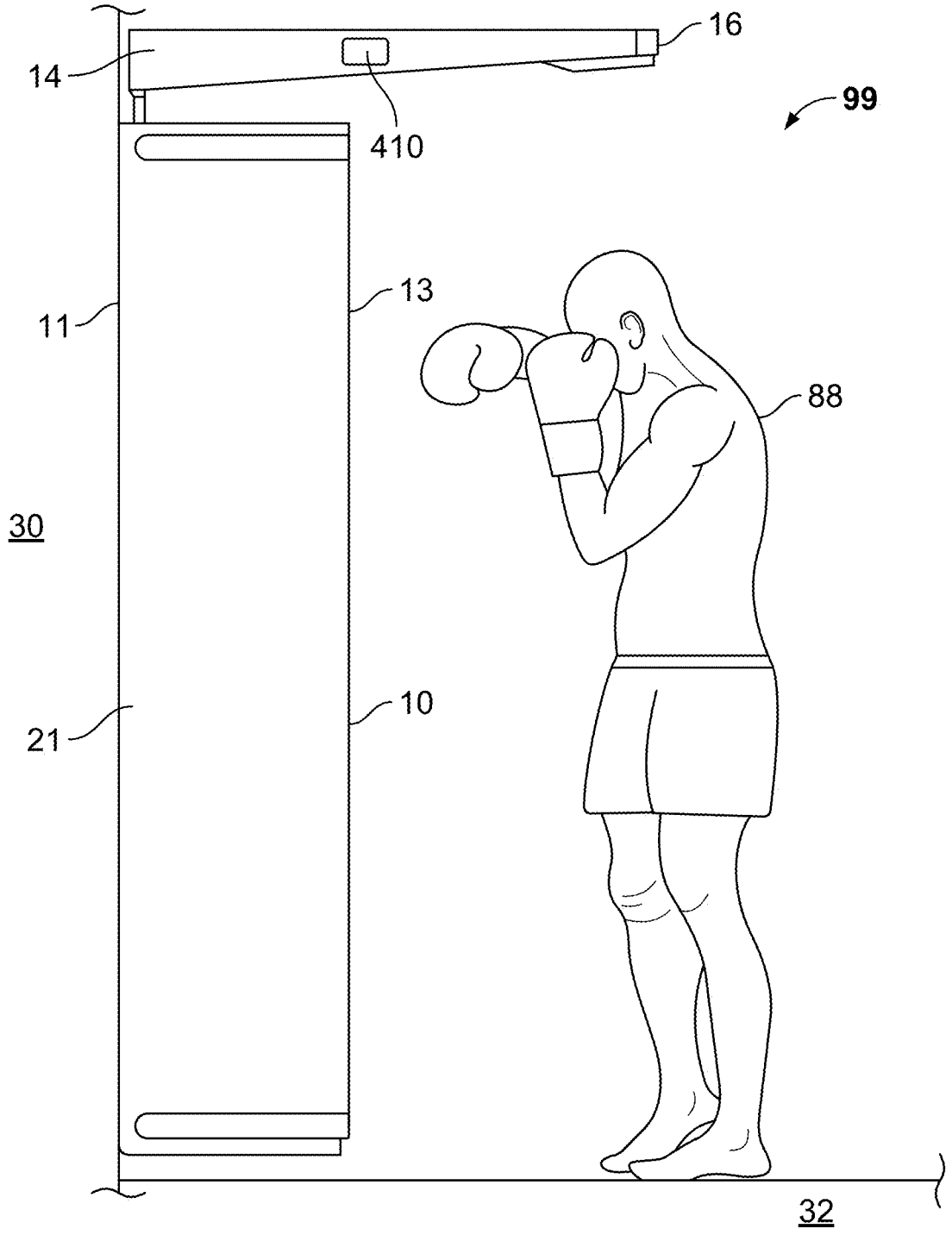
FIG. 1 is a side view of a system for providing a fitness experience to a user in accordance with some non-limiting implementations of the present technology.
Figure 7:
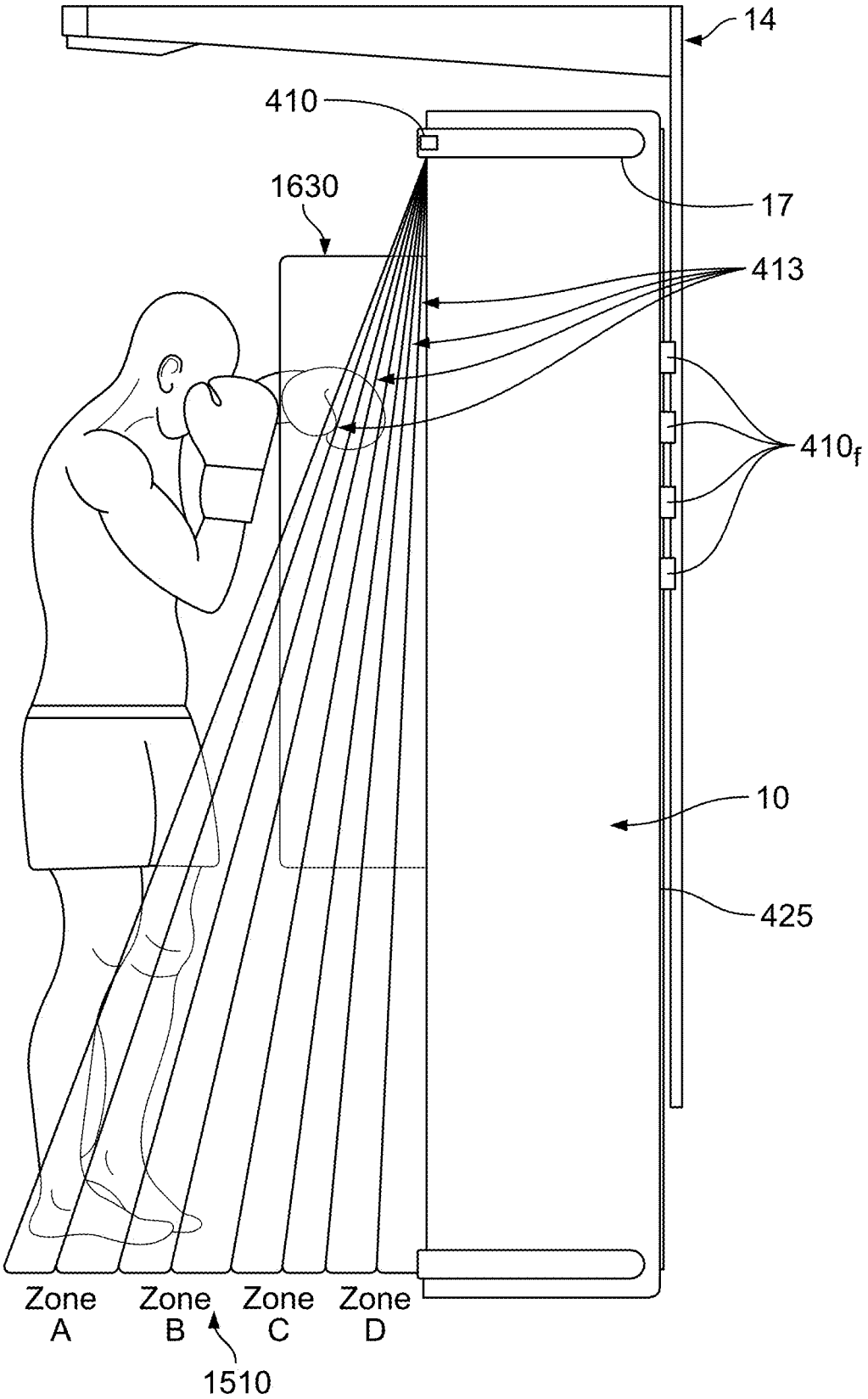
Figure 8B:
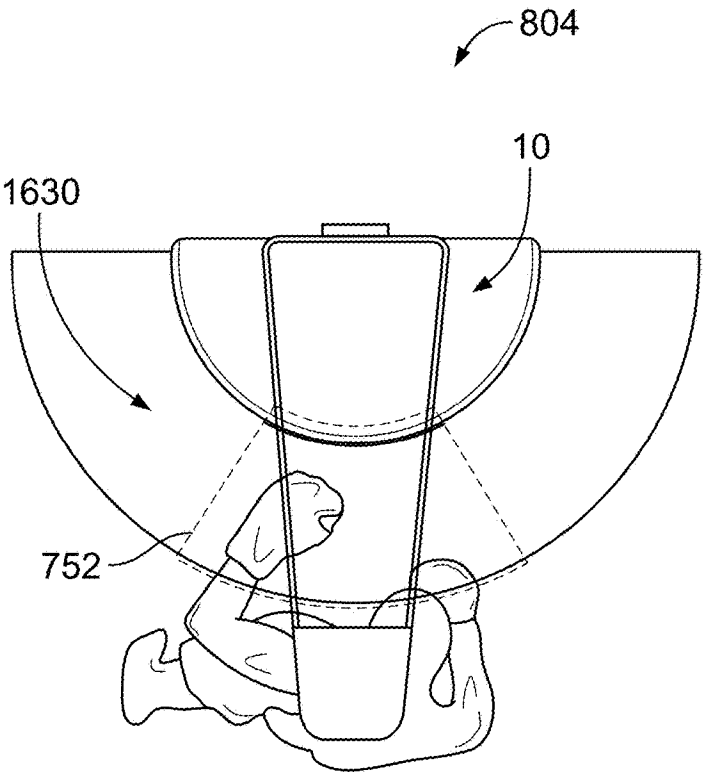
Figure 8A:
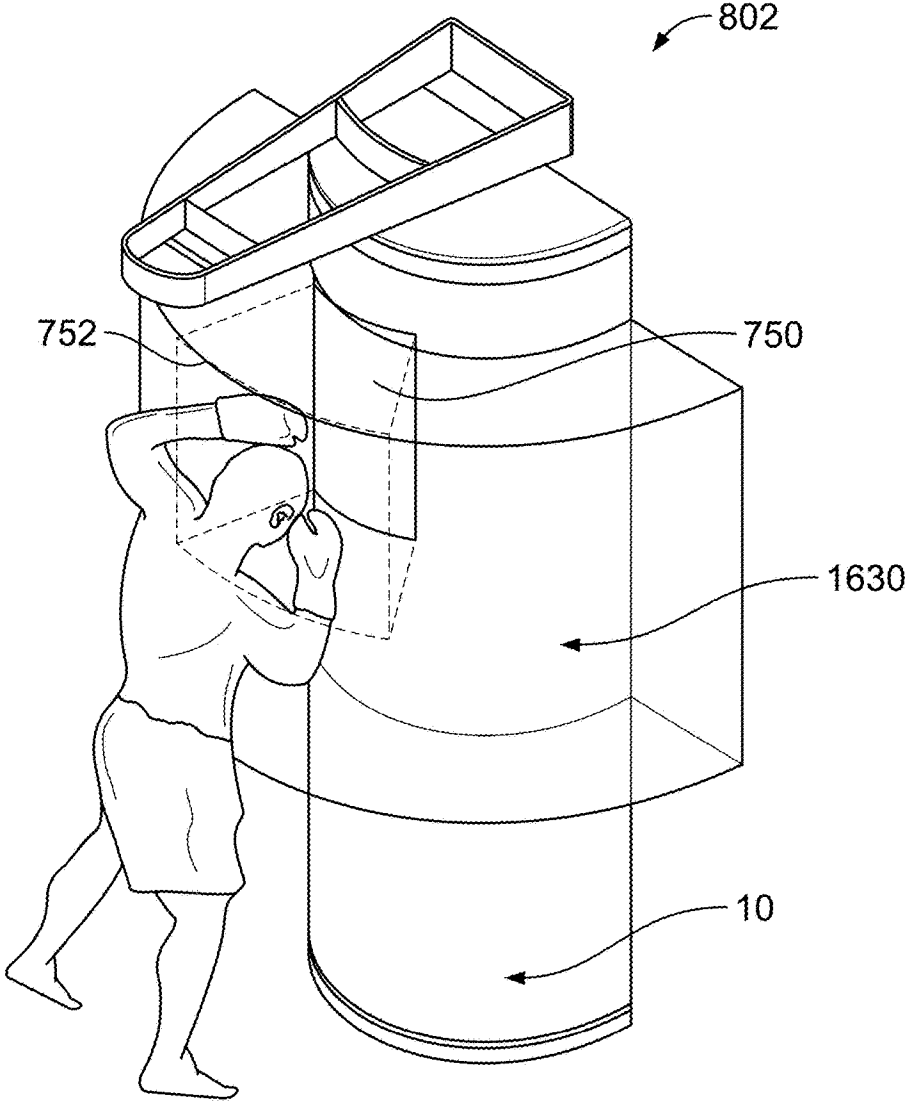
Figure 9:
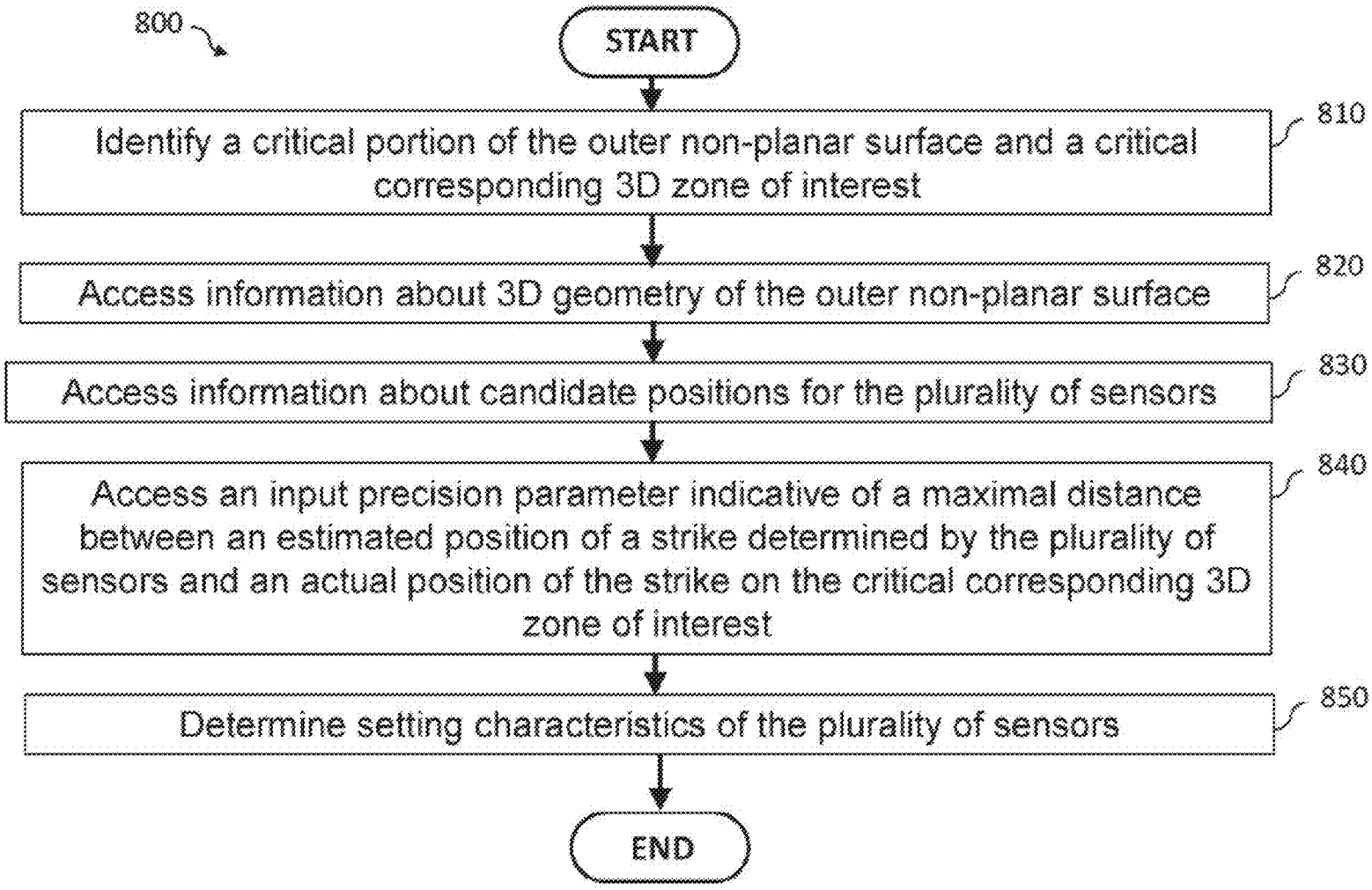
Figure 10:
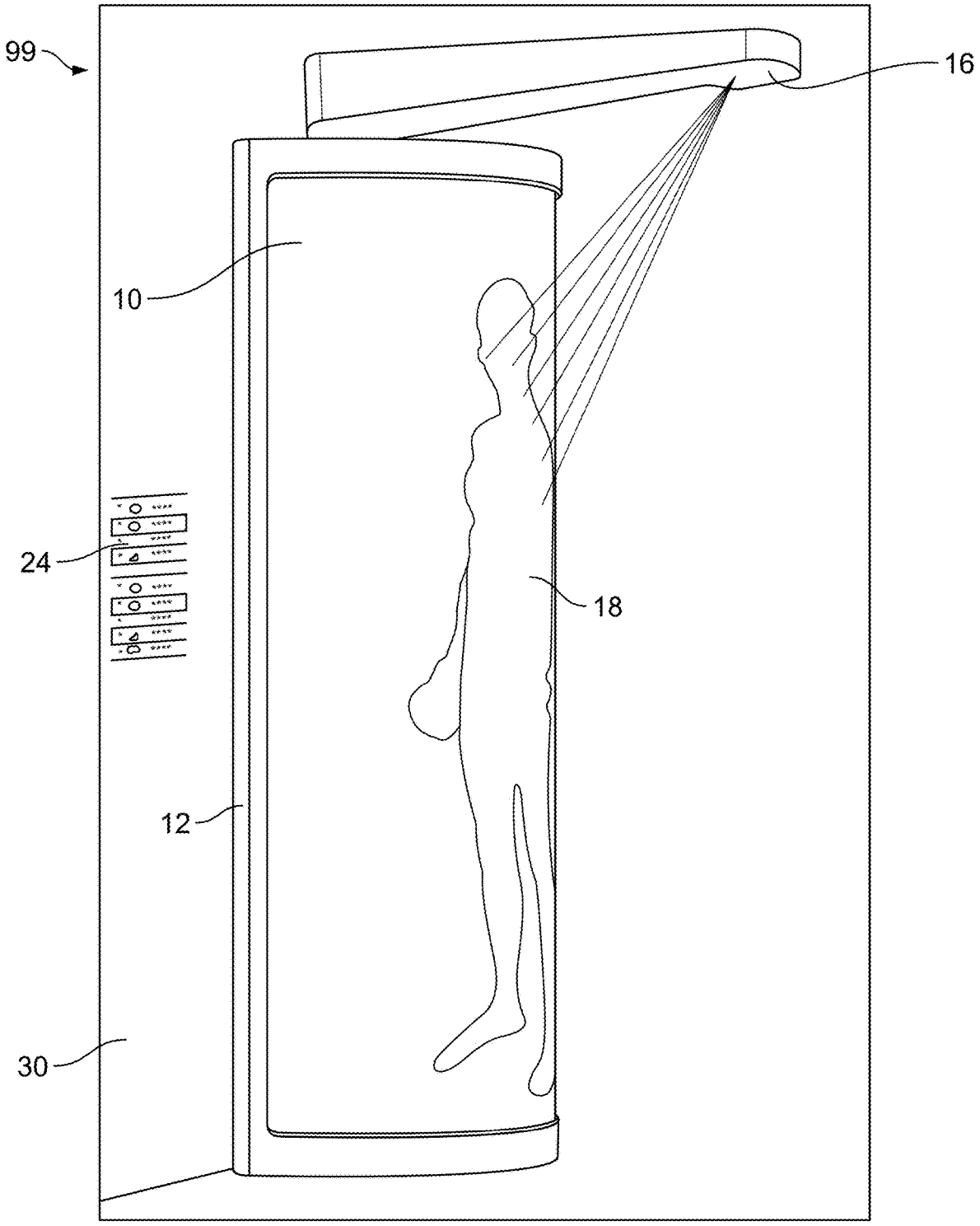
Figure 11:
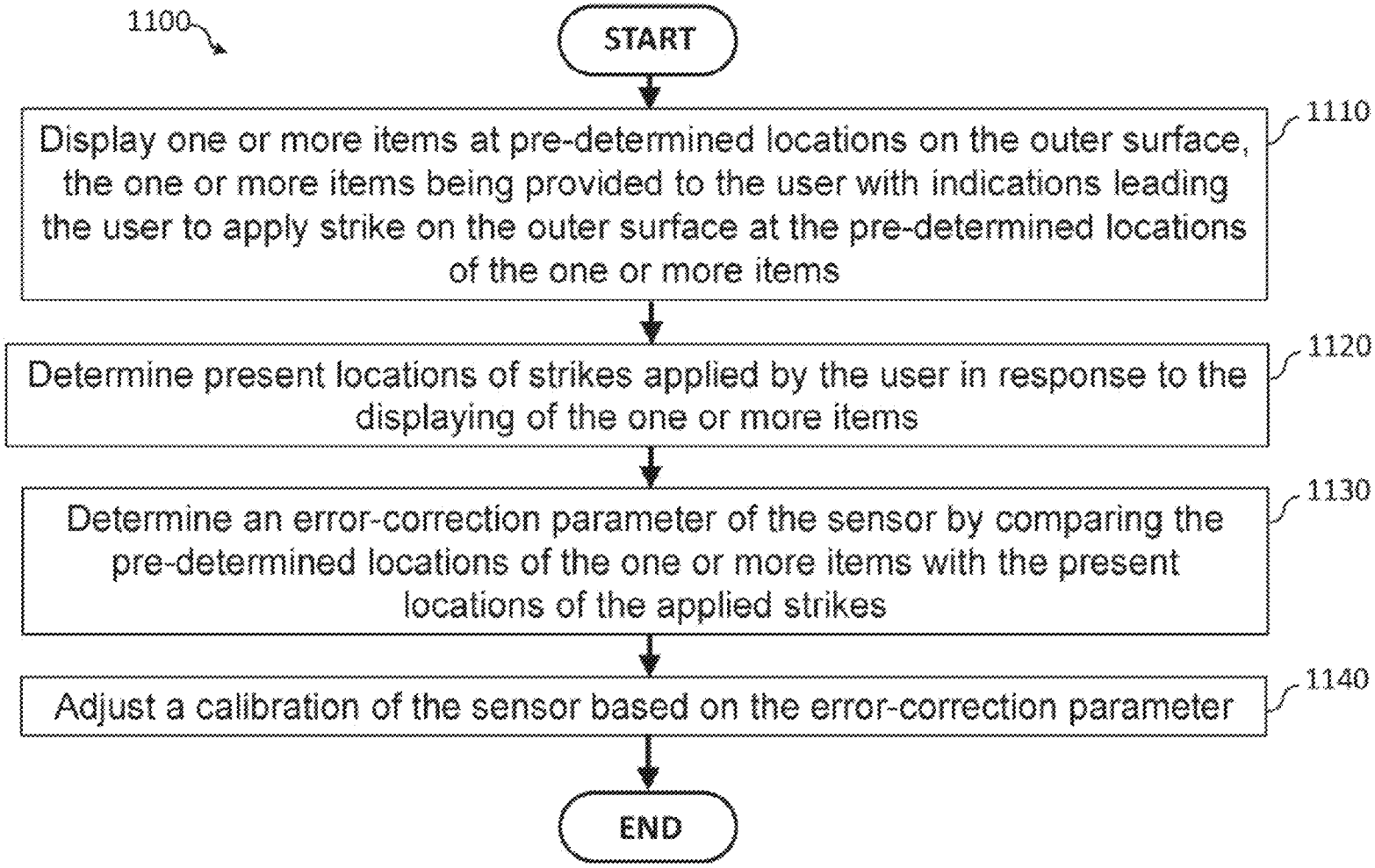
Figure 12B:
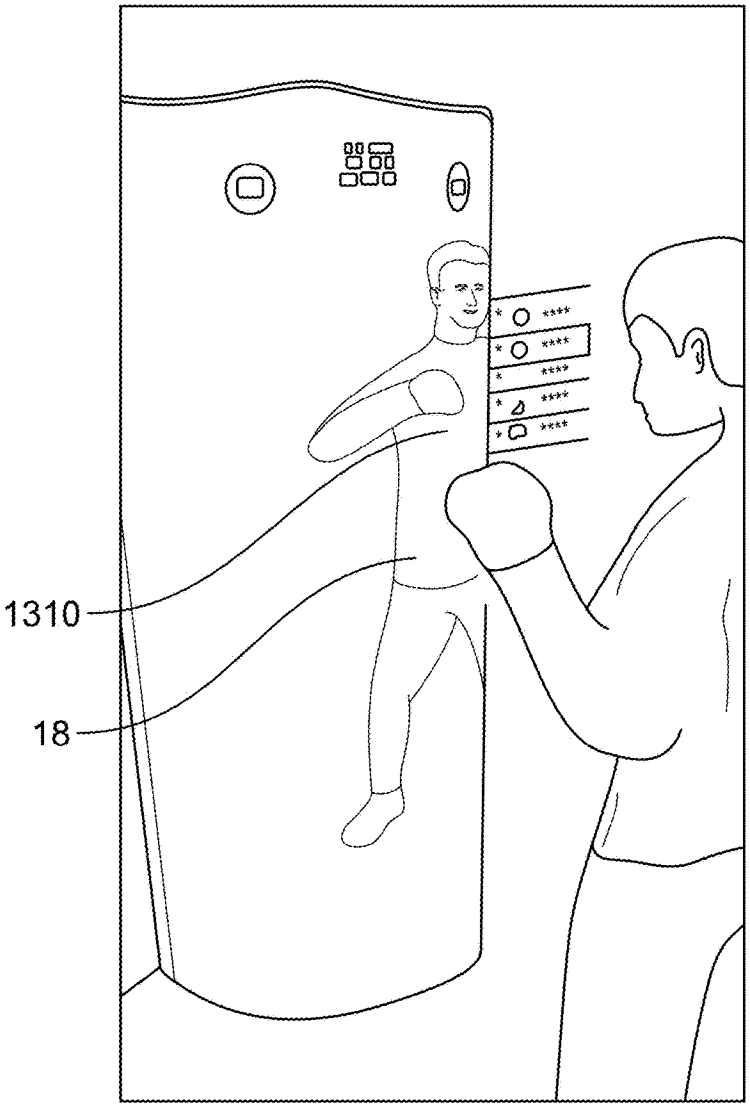
Figure 12A:
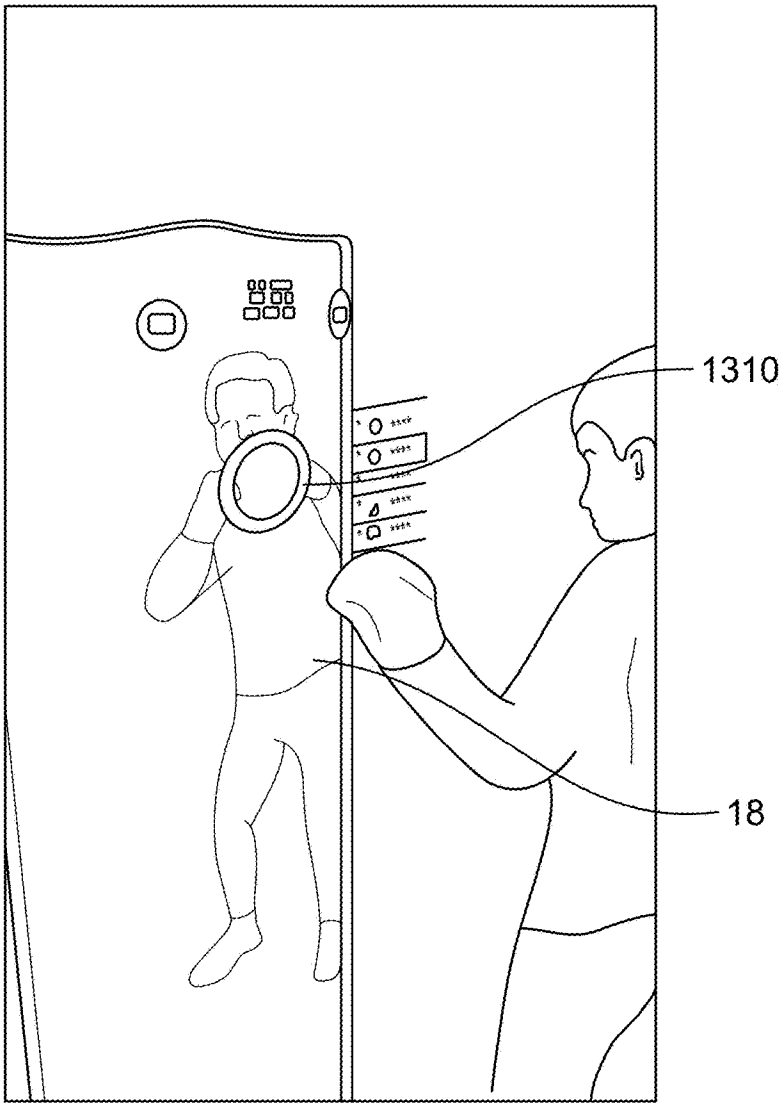
Figure 13:
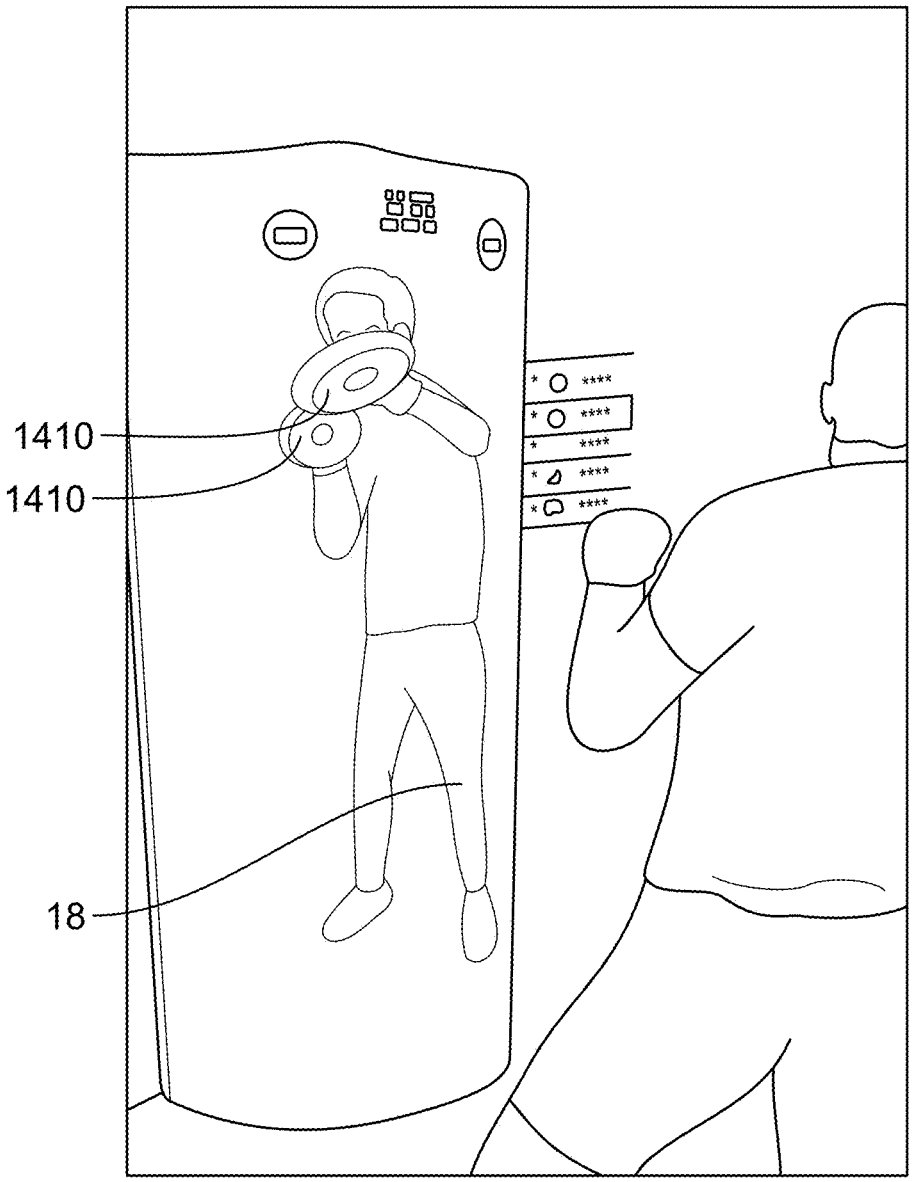
Figures 14A, 14B:
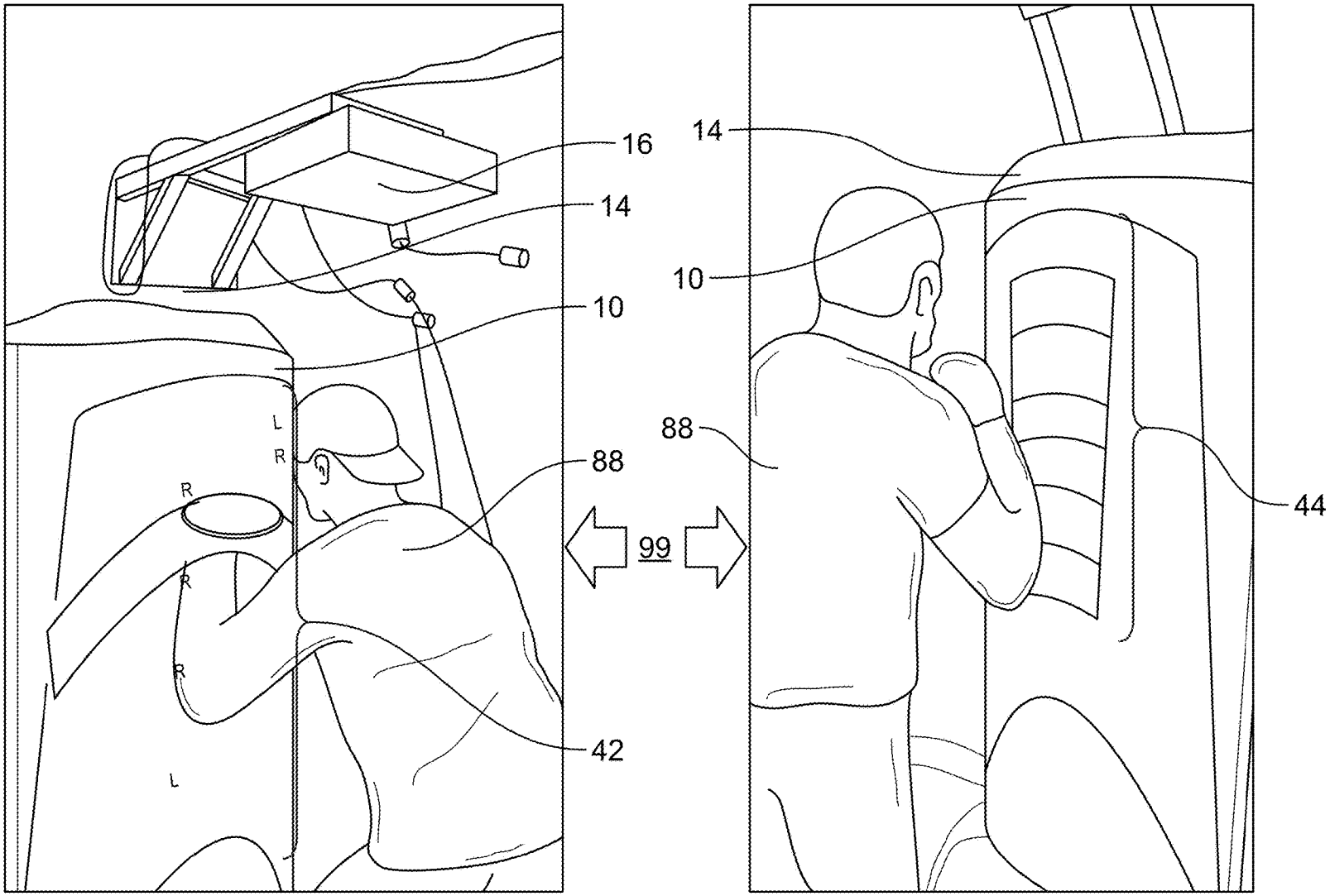
Figure 15:
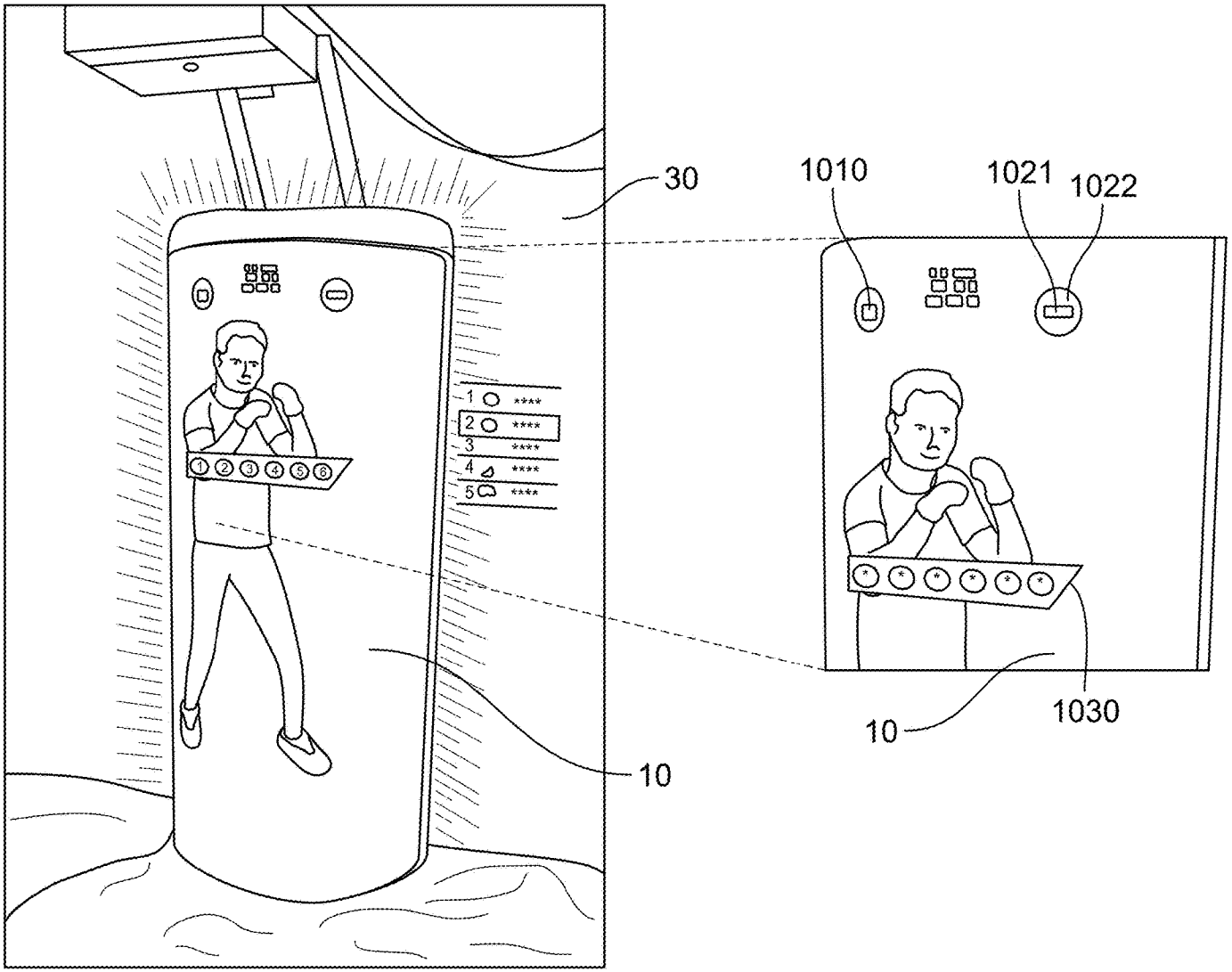
Figure 16A:
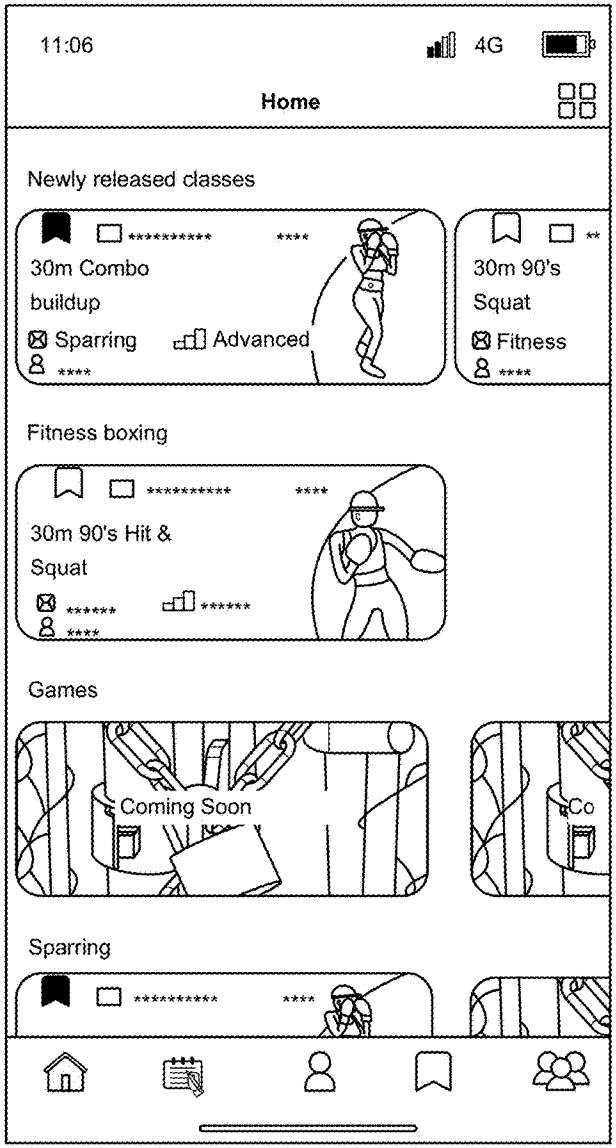
Figure 16B:
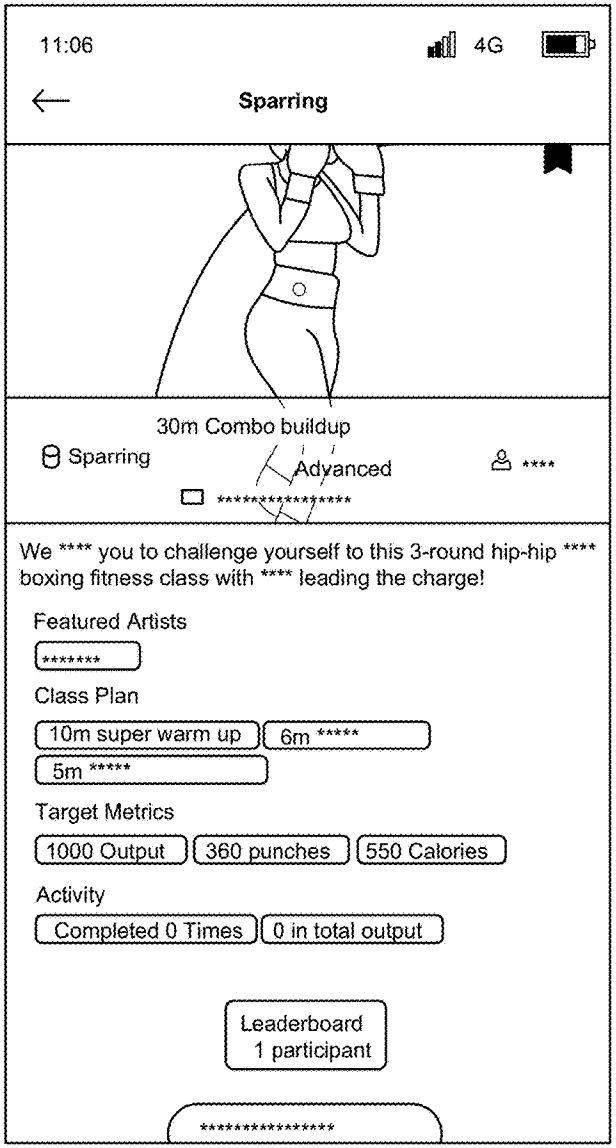
Figure 16C:
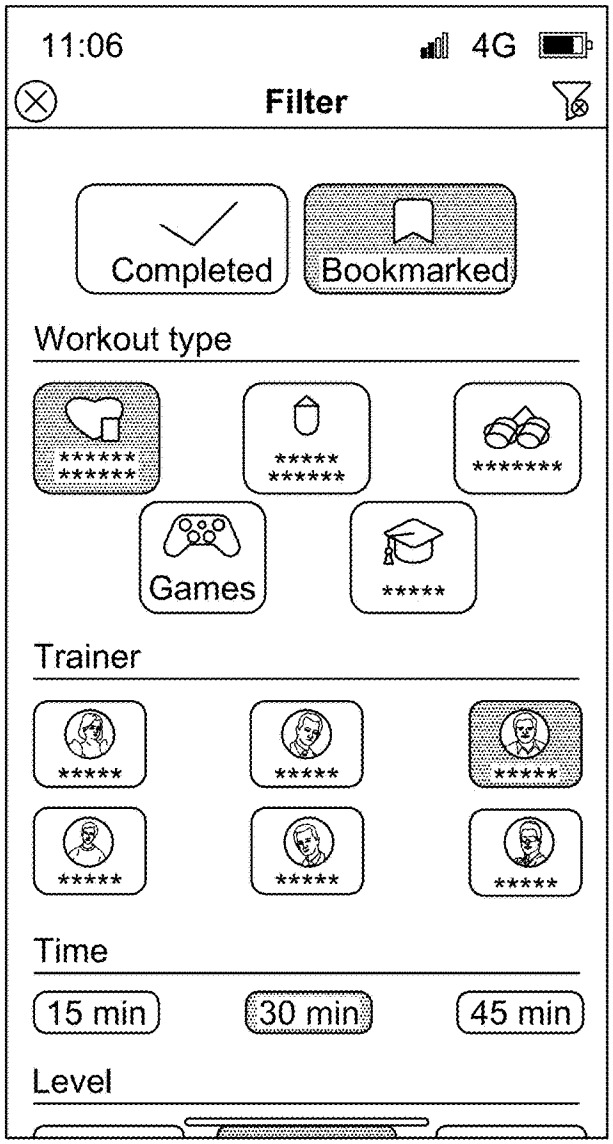
Figure 16D:
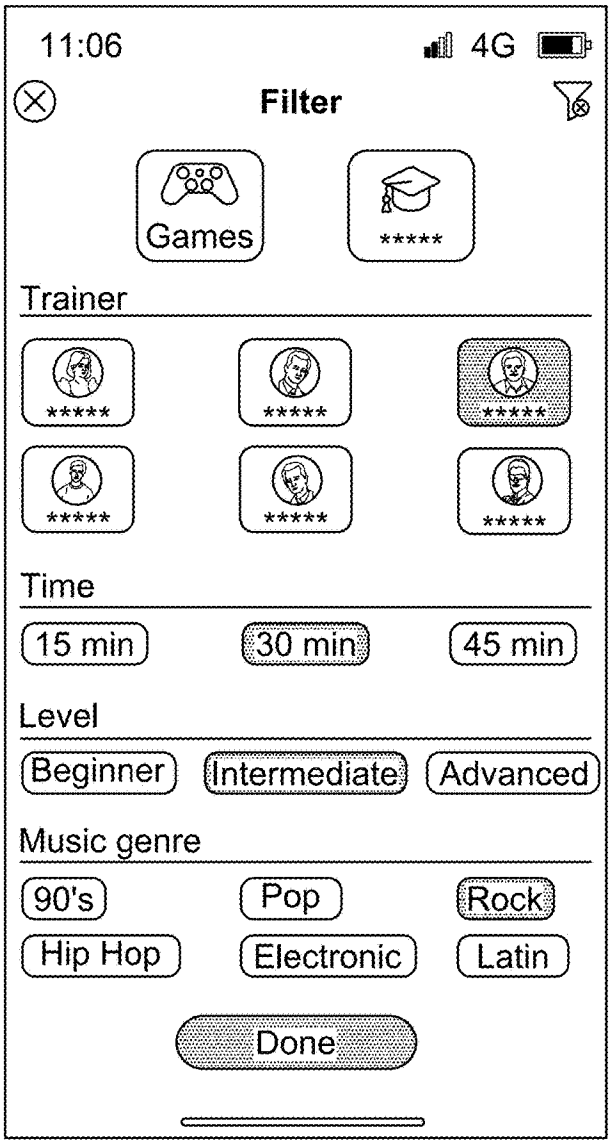
Figure 16E:
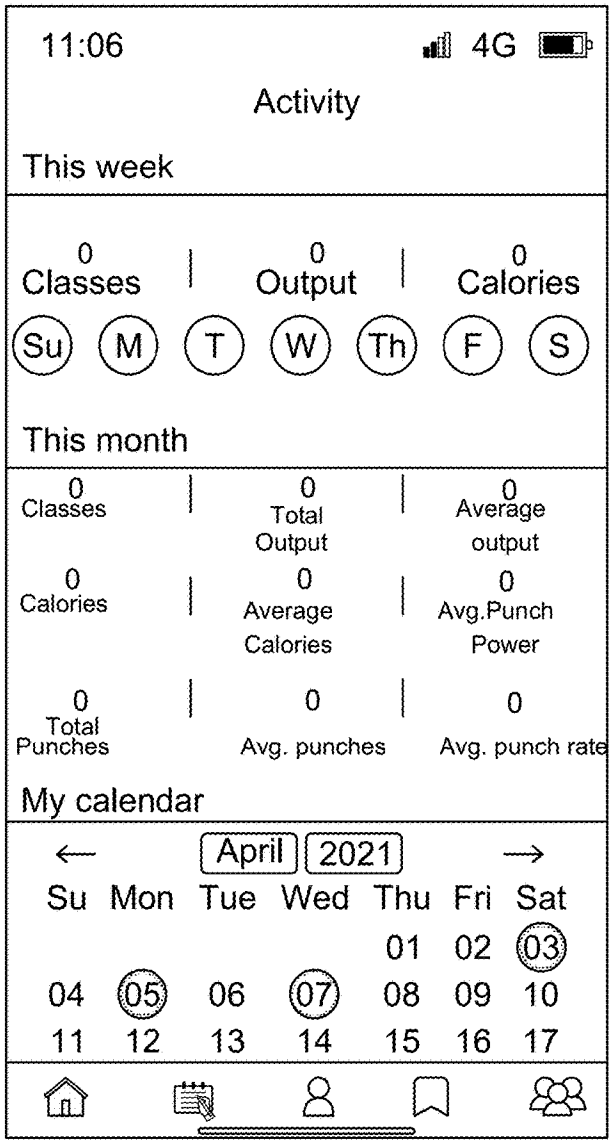
Figure 16F:
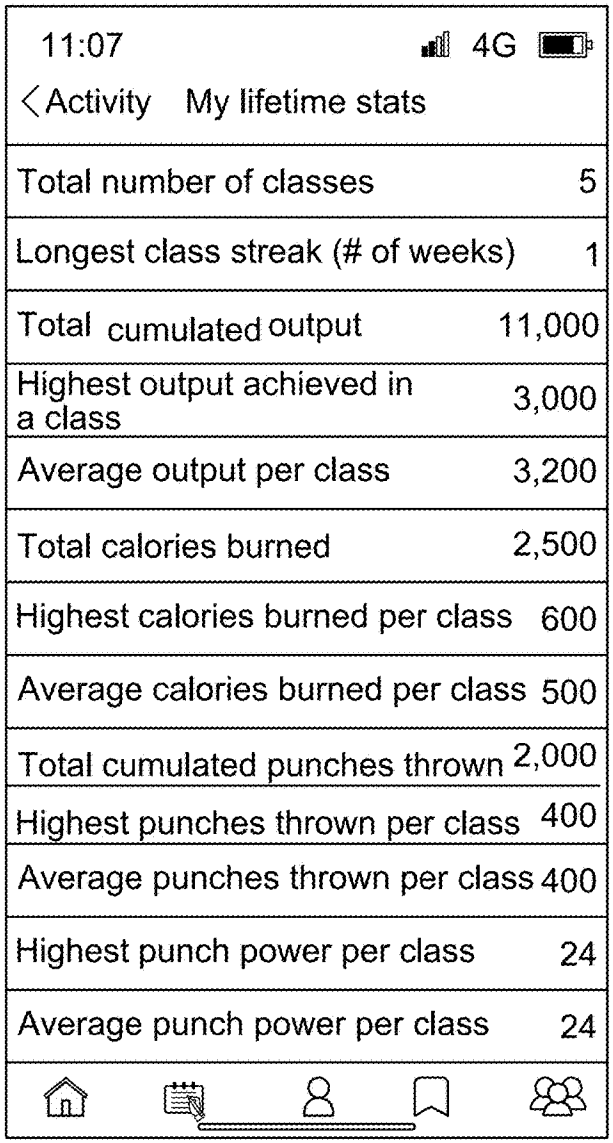
Figure 16G:
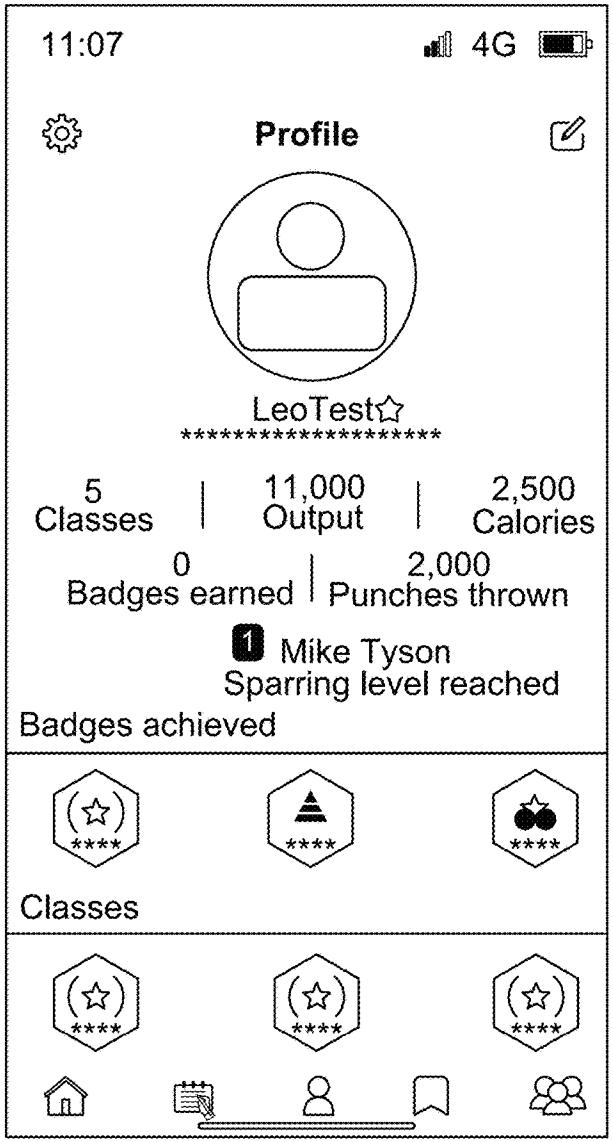
Figure 16H:
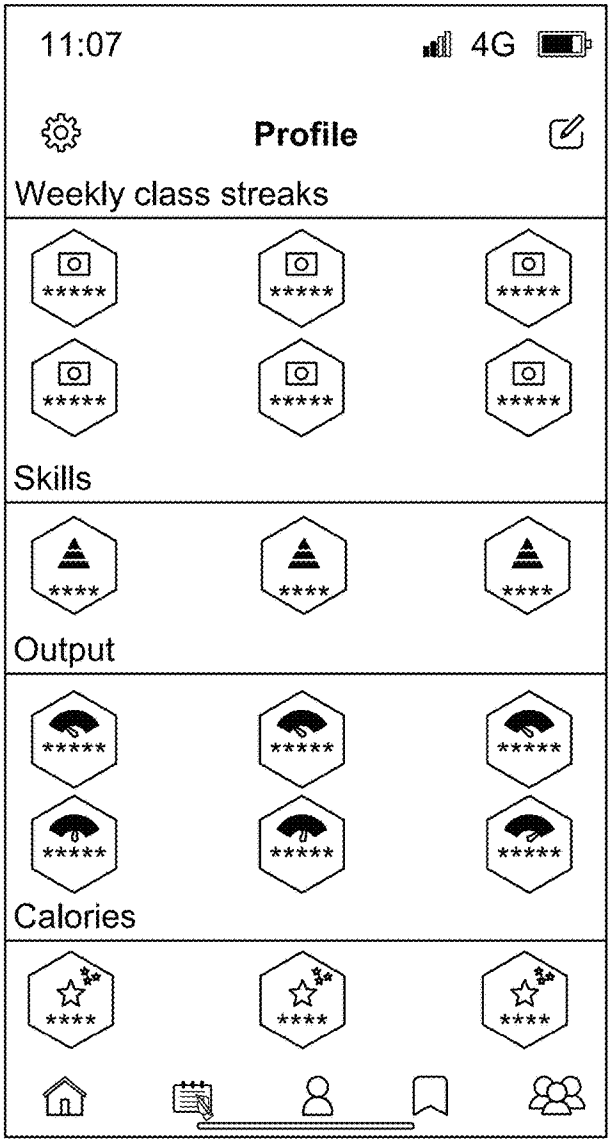
Figure 16I:
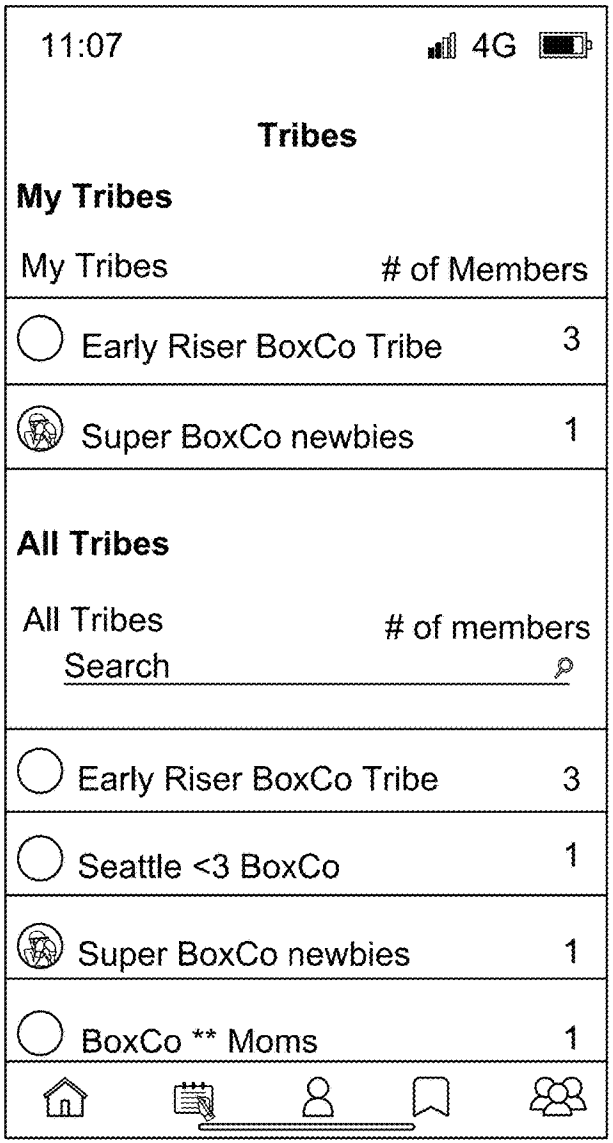
Figure 16J:
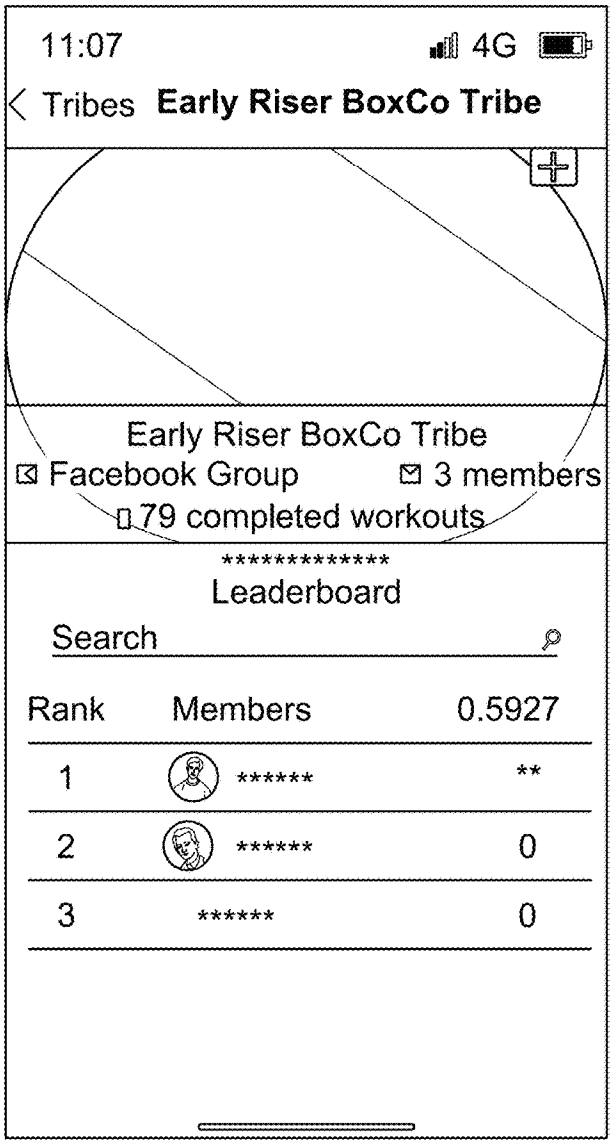
Figure 17:
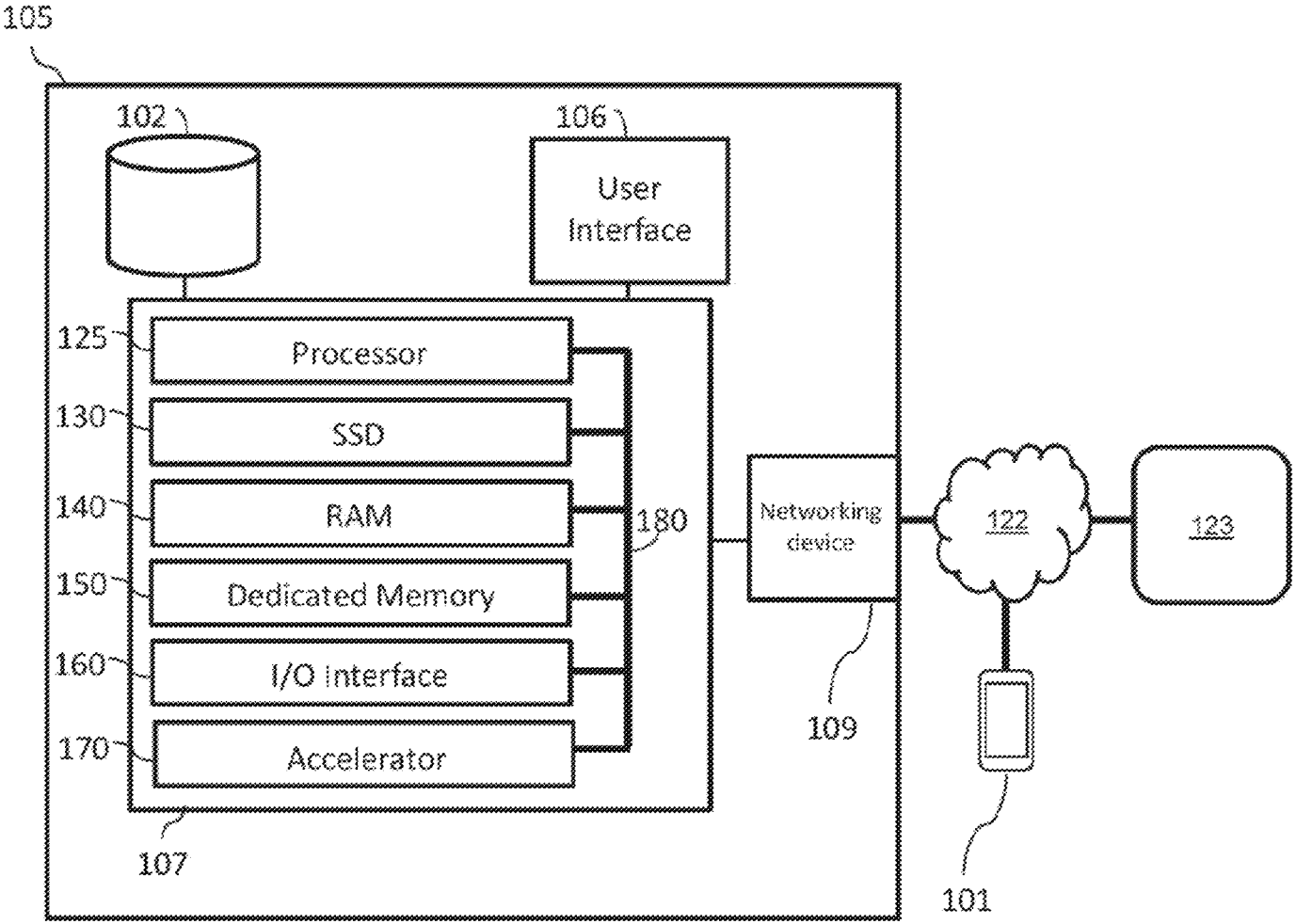

FIG. 7. is a representation of a sensing of movement and/or strikes in a zone of interest defined by the system of FIG. 1;

FIGS. 8A and 8B illustrate a perspective view and a top view of a zone of interest of FIG. 7;

FIG. 9 is a flow chart showing operations of a method for determining setting characteristics of a plurality of sensors configured for determining localization of strikes of the user on an outer non-planar surface of the punching bag in accordance with some non-limiting implementations of the present technology;

FIG. 10 is a perspective view of the system of FIG. 1 with an image projecting device thereof projecting a content in accordance with some non-limiting implementations of the present technology;

FIG. 11 is a flow chart showing operations of a method for executing a sensor calibration procedure of sensors of the system of FIG. 1 in accordance with some non-limiting implementations of the present technology;

FIGS. 12A and 12B are pictures of the system of FIG. 1 with a boxing-related dynamic content projected on a punching bag of the system of FIG. 1 in accordance with some non-limiting implementations of the present technology;

FIG. 13 is a picture of the system of FIG. 1 with another boxing-related dynamic content projected on the punching bag of the system of FIG. 1 in accordance with some non-limiting implementations of the present technology;

FIGS. 14A and 14B are pictures of the system of FIG. 1 with a gaming-related dynamic content projected on a punching bag of the system of FIG. 1 in accordance with some non-limiting implementations of the present technology;

FIG. 15 is a picture of the system of FIG. 1 with a supporting information content projected on the punching bag of the system of FIG. 1 in accordance with some non-limiting implementations of the present technology;

FIGS. 16A to 16J are representations of a graphical-user interface (GUI) for communication between the user and the system of FIG. 1 in accordance with some non-limiting implementations of the present technology; and FIG. 17 is a block diagram of a computing unit of the system of FIG. 1 in accordance with some non-limiting implementations of the present technology.

DETAILED DESCRIPTION

Implementations of the exemplified technology are now described with reference to the drawing figures. Persons of ordinary skill in the art will appreciate that the description and figures illustrate rather than limit the technology and that in general the figures are not drawn to scale for clarity of presentation. Such skilled persons will also realize that many more implementations are possible by applying the principles contained herein and that such implementations fall within the scope of the technology which is not to be limited except by any appended claims.

Some drawing figures may describe process flows for building components or elements of the system and implementations of the present technology. The process flows, which may be a sequence of steps for building a device, components, or elements, may have many structures, numerals and labels that may be common between two or more adjacent steps. In such cases, some labels, reference numerals and structures used for a certain step's figure may have been described in the previous steps' figures.

Implementations of the described technology may be useful in the forming of various systems and apparatus. Some of the various systems may form and represent a new connected fitness product in the field of boxing, designed to be installed and used in an at-home environment by individuals. Some of the various systems may form and represent a new connected fitness product in the field of boxing, designed to be installed and used in a commercial environment by individuals or groups of individuals.

Overall System

Figure 2B:
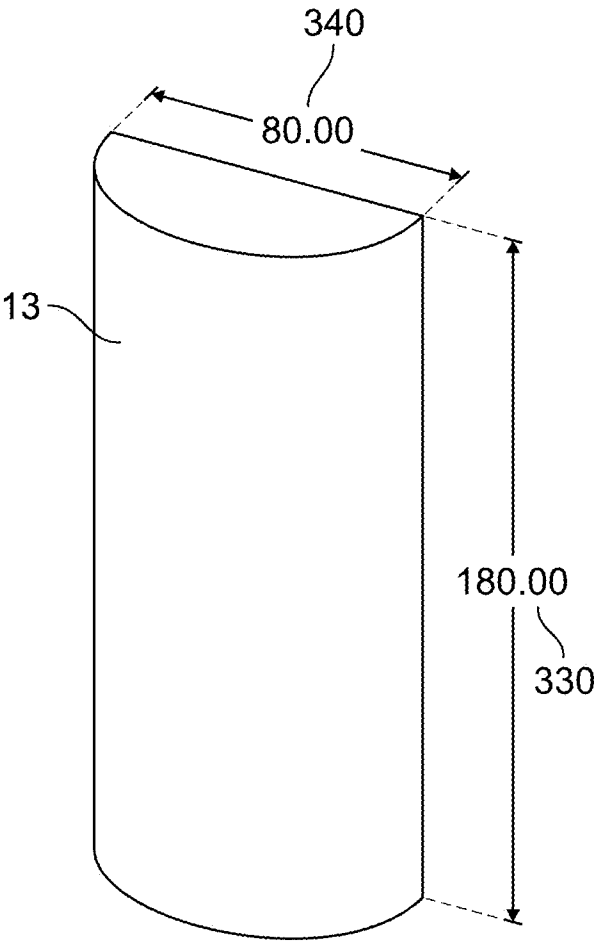
FIGS. 2A and 2B are a top view and a perspective view of a punching bag of the system of FIG. 1.
Figure 2A:
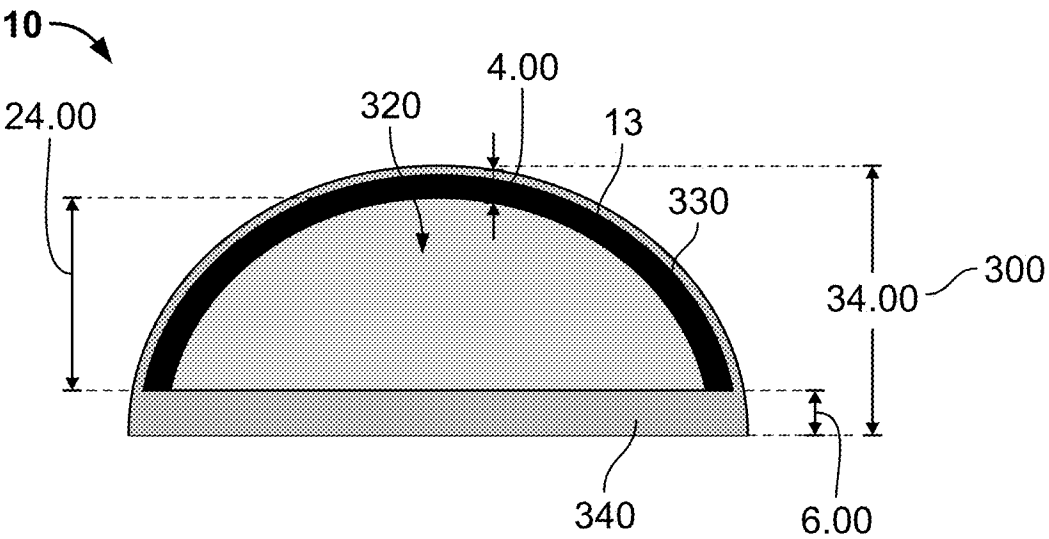
Figure 3:
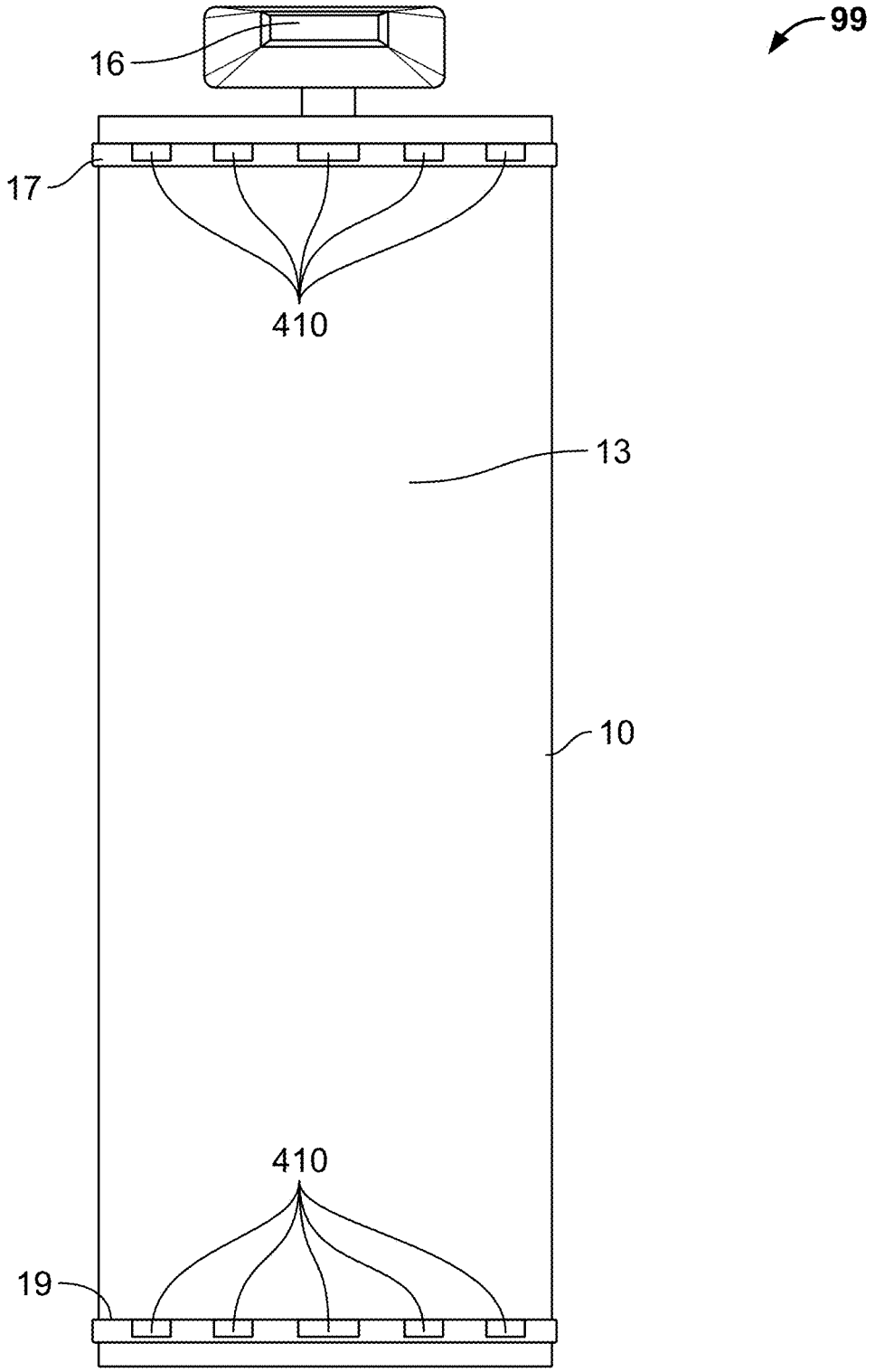
FIG. 3 is a front elevation view of the system of FIG. 1.

With reference to FIGS. 1 to 3, there is depicted a system 99 for providing a fitness experience to a user 88. In this implementation, the system 99 includes a punching bag 10, an image projecting device 16 and a sensor 410. In use, the sensor 410 generates data about strikes applied by the user 88 on the punching bag 10 and the image projecting device 16 projects a dynamic content on an outer non-planar surface 13 of the punching bag 10. Generation of said data and projection of said content are described in greater details herein after. In the context of the present disclosure, a "strike" is any hit or physical contact that the user 88 may apply to the punching bag 10 using, for example and without limitation, a hand, a knee, an elbow, a head, a foot, a shin, or any other portion of a body of the user. A strike may also be applied by the user 88 using a piece of equipment such as gloves, a katana, a wood stick, or any other sport equipment.

The sensor 410 and the image projecting device 16 are communicably connected to a computing unit 105 (see FIG. 17) of the system 99. More specifically, the computing unit 105 receives data about strikes applied by the user 88 on the punching bag 10 from the sensor 410 and may dynamically adjust the dynamic content projected by image projecting device 16 based at least in part on data provided by the sensor 410. The computing unit 105 may be supported by a mounting arm 14 or be remote with respect to the punching bag 10. The sensor 410 and the image projecting device 16 may communicatively connected to the computing unit 105 over a communication network via any wired or wireless communication link including, for example, 4G, LTE, Wi-Fi, RS485, HDMI, AUSB, CAN, 12C, SPI, LVDS, MIPI, Ethernet or any other suitable connection. Said communication network can be implemented as any wide-area communication network, local-area communication network, private communication network and the like. How the communication links between the sensor 410, the image projecting device 16 and the computing unit 105 are implemented will depend inter alia on how the sensor 410, the image projecting device 16 and the computing unit 105 are implemented.

In this implementation, the sensor 410 is disposed on the mounting arm 14 and is thus mechanically independent from the punching bag 10. As such, the sensor 410 may be unaffected by strikes given by the user 88. In other words, a position, an orientation and performances of the sensor 410 are not altered by strikes of the user 88, which helps in preserving the sensor 410.

In use, the sensor 410 may generate data about characteristics of any given strike of the user 88 on the outer non-planar surface 13 (e.g. a force of the strike, a location on the punching bag 10 of the strike or any other relevant characteristics of the strike) and/or a movement of the user 88 in a vicinity of the punching bag 10. In this implementation, the sensor 410 may include one or more of a distance sensor, a multizone distance sensor, a 2D imager and/or a 3D imager. More specifically, the sensors 410 may include accelerometer sensor, an infrared sensor, an ultrasonic sensor, a laser-ranging sensor, a time-of-flight sensor, a time-of-flight multizone sensor, a Millimeter-wave radar, a Red-Green-Blue (RGB) camera, a monochromatic camera, an optical-flow small camera, a structured-light depth sensor, a 3D time of-flight depth sensor, a stereoscopic depth camera, a LiDAR depth sensor and/or any other sensor suitable for generating said data.

Broadly speaking, the computing unit 105 may determine exercise performance metrics based on said data provided by the sensor 410. The computing unit 105 may further dynamically adjust the dynamic content projected by the image projecting device 16. For example, the image projecting device 16 may project a human-size sparring partner or coach, items, indication of performance metrics, leaderboards, dashboards, interfaces of social media platforms, or any content suitable for providing the fitness experience to the user 88. It can be said that the combination of the dynamic content projected by the image projecting device 16 and the sensor 410 that may determine interaction of the user 88 with the punching bag, and thus the dynamic content projected onto the punching bag 10, form a graphical user-interface, or "tactile" interface, between the user 88 and the computing unit 105. The computing unit 105 may generate the exercise performance metrics of the user 88 by comparing data provided by the sensors 410, and thus indicative of interaction of the user 88 with the dynamic content, with reference exercise metrics (e.g. expected position of a strike, expected strength).

In this implementation, the sensor 410 may be disposed on the mounting arm 14 centered above the punching bag 10 and extending from a wall mounting frame 21 of the system. As best shown on FIG. 1, the punching bag 10 may be, in some non-limiting implementations, mechanically connected to a wall 30 of a building. More specifically, in this implementation, the punching bag 10 defines a flat back surface 11 that may be maintained against the wall 30 by the wall mounting frame 21 of the system 99. The punching bag 10 may thus be elevated with respect to a ground surface 32 of the building where the user 88 stands. The ground surface 32 may be a ground or a floor of the building, a mat, or any substantially horizontal surface on which the user 88 may be to perform a fitness activity using the system 99. In this implementation, the wall mounting frame 21 supports the punching bag 10 and is mechanically connected to the wall 30. For example, the wall mounting frame 21 may be fixedly attached to one or more studs defined in the wall 30. As such, the system 99 is a relatively easy-to-integrate form factor in at at-home environment. Moreover, the wall mounting frame 21 fixedly attaching the punching bag 10 to the wall may also eliminate constant movement associated with traditional boxing bags when being struck, thereby providing a more dynamic fitness experience to the user 88 without balancing movement of the punching bag. As well, the wall mounting frame 21 may eliminate the need to fill a base with water or sand which is traditional for freestanding punching bags. The wall mounting frame 21 may be made of steel, aluminum, plastics, composites, any other suitable materials or a combination thereof.

In some implementation, the mounting arm 14 may be independent from the punching bag 10 (e.g. not structurally attached thereto). For example, the mounting arm 14 may be directly and fixedly attached to one or more studs defined in the wall 30.

It should be noted that, although illustrative examples of the fitness activity are related to boxing activity, other sports are contemplated, such as karate or jujitsu and/or fitness activity that do not involve strikes of the user 88 such as weightlifting, yoga, Pilates, dance, barre, ballet, High-intensity interval training (HIIT), cardiovascular exercises, stretching, relaxation and/or meditation. A fitness activity may also be any activity that may involve a physical movement of the user 88, such as E-commerce/Shopping activity, health/telemedicine/rehabilitation activity and/or gaming activity.

For example, the user 88 may be provided with a shopping experience where the sensor 410 is used to map in 3D and real-time the morphology of the user and uses this information to superimpose onto the user a particular item of clothing. The user 88 may see the output of him or her wearing this item of digital clothing projected digitally thanks to the resulting combined/superimposed image of the user and clothing item being projected on the surface of the bag 10 in life-size form. The user may then decide to make a purchase or move on to another item of clothing. The user may also be provided with a selection of sizes and/or color.

As another example, the user 88 may be provided with a healthcare experience where the sensor (e.g. a Red-Blue-Green embedded camera) and a microphone array are used to initiate a long-distance, telemedicine patient-to-doctor live video call, with the image and voice of the user/patient being captured by the sensor and microphone array, an image of the doctor being projected onto the surface of the punching bag 10. The computing unit 105 may be coupled with a smart wearable device in order to be able to provide to the doctor with biometric data about the user 88 in real time during the call, including for example, heart rate & historical data, blood oxygen level & historical data, blood glucose level & historical data.

In some implementations, the system 99 may be used simultaneously by a plurality of users 88. For example, a fitness class may be provided to two users 88, said fitness class being delivered through a dynamic content including a first human-representation of a coach providing instructions to a first one of the users 88 (e.g. boxing exercises), and a second human-representation of a second coach providing instructions to a second one of the users 88. The second human-representation may be projected in smaller form relatively to the first human-representation and may be, for example, directly projected onto the wall 30.

In some implementations, the system 99 includes one or more microphones. For example, a microphone may be integrated in the mounting arm 14, and may include a 7-microphone array for far-field speech and sound capture.

Microphones may be placed on the mounting arm 14 and/or within the punching bag 10. In the same or other implementations, the system 99 includes one or more speakers. Placement of the speakers may be determined by engineering, design, and product feature considerations. Some speakers may be integrated onto the mounting arm 14, for example a set of stereo speakers to deliver sound to the user 88 during the fitness activity.

In the same or other implementations, the system 99 may include one or more power supply units. A power supply unit may be integrated onto the mounting arm 14 to provide power to the various electronic components of the system 99, for example: the computing unit 105, the image projecting device 16, the sensor 410, and/or other components of the system 99 described therein.

Punching Bag

In this implementation and as best shown on FIG. 2, the outer non-planar surface 13 has a given elliptical ratio. The developers of the present technology have devised such a non-planarity of the outer non-planar surface 13 to improve the immersivity of the fitness experience of the user 88. For example, for a boxing-related experience, striking on a planar surface may render traditional boxing moves such as hooks difficult to achieve by the user 88, However, projection of the dynamic content and detection of the strikes and movements of the user 88 with respect to the punching bag 10 have been adapted based on said non-planarity of the outer non-planar surface 13.

Indeed, projection of the dynamic content on a substantially planar surface (i.e. having a relatively high elliptical ratio) may be performed without substantial distortion appearing on external sides of the content. On the opposite, projecting on a content on a non-planar surface may require applying image correction such that a display of the dynamic content does not appear distorted by the user 88.

Similarly, coverage of the outer non-planar surface 13 by field-of-views of the sensors 410 to efficiently and accurately detect strikes and movements of the user 88 may require specific adjustment in a number, type and disposition of the sensors 410 based on the 3D geometry of the outer non-planar surface 13.

As it will be described in greater details herein after, developers of the present technology have devised an image correction for the dynamic content and a specific disposition of the sensors 410 based on based on the 3D geometry of the outer non-planar surface 13. As such, any system variation configured to project a content on a non-planar surface and/or to perform object detection and interaction detection with a non-planar surface can be adapted to execute implementations of the present technology, once teachings presented herein are appreciated.

In this implementation, the elliptical ratio of the outer non-planar surface 13 is between 5% and 50% and a height of the punching bag is between 1 meter and 2.5 meters, and a width of the punching bag is between 0.5 meter and 2 meters. Furthermore, as shown on FIG. 2, the punching bag 10 may include a plurality (e.g. three) separate layers of foam 320, 330, 340 characterized by different degrees of depth (thickness) and density. The plurality of layers may include layers of high-density foam, for example, such as high density conventional polyurethane foam with about 40 kg/m3 density. The plurality of layers may also include one or more layers of super soft foam, for example, such as super-soft, high resilience polyurethane foam with about 25 kg/m3 density. Outermost and middle layers may be made of high-density and rigid material to provide the user 88 with a firm touch upon impact of the strikes while allowing for immediate return to form after impact. Innermost layer of the punching bag 10 may be made of a super-soft material for absorbing shocks and vibration generated by the user 88. In some implementations, additional layers of shock- and vibration-absorbing materials such as, rubber, wood, springs, shock-absorbers, are disposed between the wall 30 and the flat back surface 11 of the punching bag 10 to provide additional cushion from shocks and vibration so as to eliminate or limit their transmission to the wall 30.

Due to the elliptical shape of the outer non-planar surface 13, the user 88 may move 150-180° degree around the punching bag 10, and therefore replicate the vast majority of movements associated with boxing such as shifting, ducking, rolling, pivoting, advancing, retreating. The user 88 may thus, for example, carry out the traditional boxing strikes such as jabs, straights, hooks, uppercuts, overhands. In some implementations, the outer non-planar surface 13 has a half-cylinder shape.

In this implementation, the outer non-planar surface 13 of the punching bag 10 may include a matte, smooth white surface suitable for sustaining strikes of the user 88 for a substantially long period of time. For example, the outer non-planar surface 13 may include leather, artificial leather or any other material that is suitable in terms of strength, smoothness, flexibility and durability. The outer non-planar surface 13 may be treated to have a substantially high reflectivity of incoming light (i.e. relatively high effective albedo) in order to have an increased rendering quality of the dynamic content projected thereon to the user 88.

Sensor Disposition

With reference to FIG. 3, the sensor 410 includes, in this implementation, a plurality of sensors 410. Developers of the present technology have realized that using a plurality of sensors 410 may increase accuracy of the system 99 in determining locations of the strikes given by the user 88 and movements thereof. In this implementation, in addition or alternatively to one or more sensors 410 disposed on the mounting arm 14, one or more other sensors 410 may be disposed on an upper portion and/or a lower portion of the punching bag 10. In this implementation, one or more sensors 410 are disposed on an upper bent member 17 disposed around the upper portion of the outer non-planar surface 13 of the punching bag 10, and on a lower bent member 19 disposed at the lower portion of the outer non-planar surface 13. Said upper and lower bent member 17, 19 may be affixed to the punching bag and/or to the wall mounting frame 21. The sensors 410 may be disposed directly on the punching bag 10 in alternative implementations. It should be noted that the sensors 410 are disposed away from a striking area of the outer non-planer surface, said striking area being expected to receive strikes of the user 88. In other words, the sensors 410 do not receive, in use, kinetic energy and/or mechanic energy from the user 88 to generate data about the strikes and/or movements of the user 88. The sensors 410 may thus operate away from a path of the energy of the strikes, which prevents the sensors 410 from being damaged during performance of the fitness activity. The upper and/or lower bent members 17, 19 may include a protective mechanical assembly for protecting the sensors 410 therein from any exterior undesired mechanical constraints.

For clarity purposes, it can be said that the sensors 410 include motion tracking sensors (e.g. cameras, distance sensors) for substantially generating data about a movement of the user 88, and striking sensors (e.g. accelerometer sensor, optical-flow smart camera) for substantially generating data about the strikes of the user 88. However, it should be noted that the computing unit 105 may use data provided by the motion tracking sensors to determine information about the strikes of the user 88, and/or may use data provided by the striking sensors to determine information about the movement of the user 88.

For example, the sensors 410 may acquire two-dimensional (2D) videos, three-dimensional (3D) videos and/or still images of the user 88 while the user 88 performs an activity, for example, such as a workout or particular boxing movement. For example, the video of the user 88 may be used for self-evaluation during or after a workout by providing a visual comparison of the user to the instructor. Stored video may also allow users to evaluate their progress or improvement when performing similar exercises over time.

The video may also be processed, in real-time during a workout or after a workout is finished by the computing unit 105 or any other computing unit, to derive biometric data of the user 88 based on the movement and motion of the user 88. For example, image analysis techniques may be used to determine various aspects of a user's workout including, but not limited to a user's breathing rate as a function of time, a user's performance in reproducing a proper form or motion of a particular exercise, the number of repetitions performed by the user during a workout, stresses on a user's limbs or joints that may lead to injury, and a user's stamina based on deviations of a particular exercise over time.

In an aspect, the system 99 is able to distinguish two strikes detected by one or more of the sensors 410 and to identify a same strike detected by two distinct sensors 410. In this implementation, striking sensors and motion tracking sensors provide complementary data about movements and strikes of the user 88. More specifically, motion tracking sensors may acquire, in use, full-body skeletal position and movement of the user, at long and medium range (e.g. 50 cm to 6 m from the motion tracking sensors). The motion tracking sensors may be characterized as medium refresh rate, typically in the range of 30 to 60 acquisitions per second. The motion tracking sensors may capture movements (in a 3D space) of a body of the user 88 and/or movements of pieces of equipment (e.g. katana, a wood stick, or any other sport equipment) of the user 88. The motion tracking sensors may be commercial-of-the-shelf sensors selected and arranged in a way that suits the specific motion tracking requirements of the system 99, such as field-of-view, range, refresh rate or mechanical integration constraints.

In this implementation, striking sensors are used for close range movement detection and localization (e.g. below 50 cm) and may be used to detect only striking ends of the user, such as their hand in a boxing glove. The striking sensors may be higher refresh rate components compared to motion tracking sensors, typically in the range of 60 to 200 acquisitions per second to capture relatively fast movement of the striking ends of the user 88. As such, a same movement may be successively acquired by the motion tracking sensors and the striking sensors, with some movements even being acquired simultaneously by the two types of sensors. In this implementation, the computing unit employs a data-fusion algorithm to identify a same strike detected by two different sensors 410. More specifically, the computing unit 105 may use statistical or machine learning-based data fusion techniques to reconnect data about movements of the user 88 acquired by a plurality of motion tracking sensors and striking sensors. In some implementations, 3D positions of a same incoming strike at different times may be averaged to compute a final 3D location of the incoming strike. This may effectively improve detection precision and mitigate the 3D uncertainty. In other word, the computing unit 105 may, based on the data provided by the sensors 410, determine a candidate trajectory of the incoming strike and identify a candidate point of impact of the incoming strike on the outer non-planar surface 13 before the incoming strike of the user enters in physical contact with the punching bag 10 based on the candidate trajectory.

Additionally, each sensor 410 may generate data about distinct simultaneous strikes of the user 88 on the outer non-planar surface 13. In some implementations, the computing unit employs a machine learning algorithm to identify and/or localize two distinct strikes simultaneously executed on the outer surface of the punching bag.

In this implementation and as best shown on FIG. 7, the sensors 410 further include force sensors 410*f* that may be accelerometers, force-sensing resistors, sets of contact electrodes, time-of-flight sensors, laser range-finders, optical encoders, linear potentiometers, rotary potentiometers or a combination thereof. For example, one or more force sensors 410*f*, mounted behind the punching bag 10 for generating data about a force of the strikes of the user by tracking displacement of the punching bag 10 relatively to the wall 30. In the context of the present disclosure, the force sensors 410*f* are considered as striking sensors among the sensors 410. In some implementation, the system 99 includes a vibration-absorption module 425 disposed between the punching bag 10 and the wall 30 of the building. In use, the force sensors 410*f* may be disposed within the vibration-absorption module 425.

In the same or another implementation, the vibration-absorption module 425 includes springs or a resilient material, the force sensors 410*f* being time-of-flight range-finders, optical encoders, linear potentiometers or rotary potentiometers, and measuring movements of the punching bag 10 relatively to the wall 30. Said movement may be determined based on, for example and without limitation, a deformation of the vibration-absorption module 425. Force of a given strike may then be computed by the computing unit 105.

In some implementations, additional force sensors 410*f* may be disposed within the punching bag 10. For example and without limitations, an interface between an outermost and middle layers of the punching bag 10 may be designed to allow for the placement of an array of force sensors 410*f*.

Sensors for Strike Detection

Figure 4:
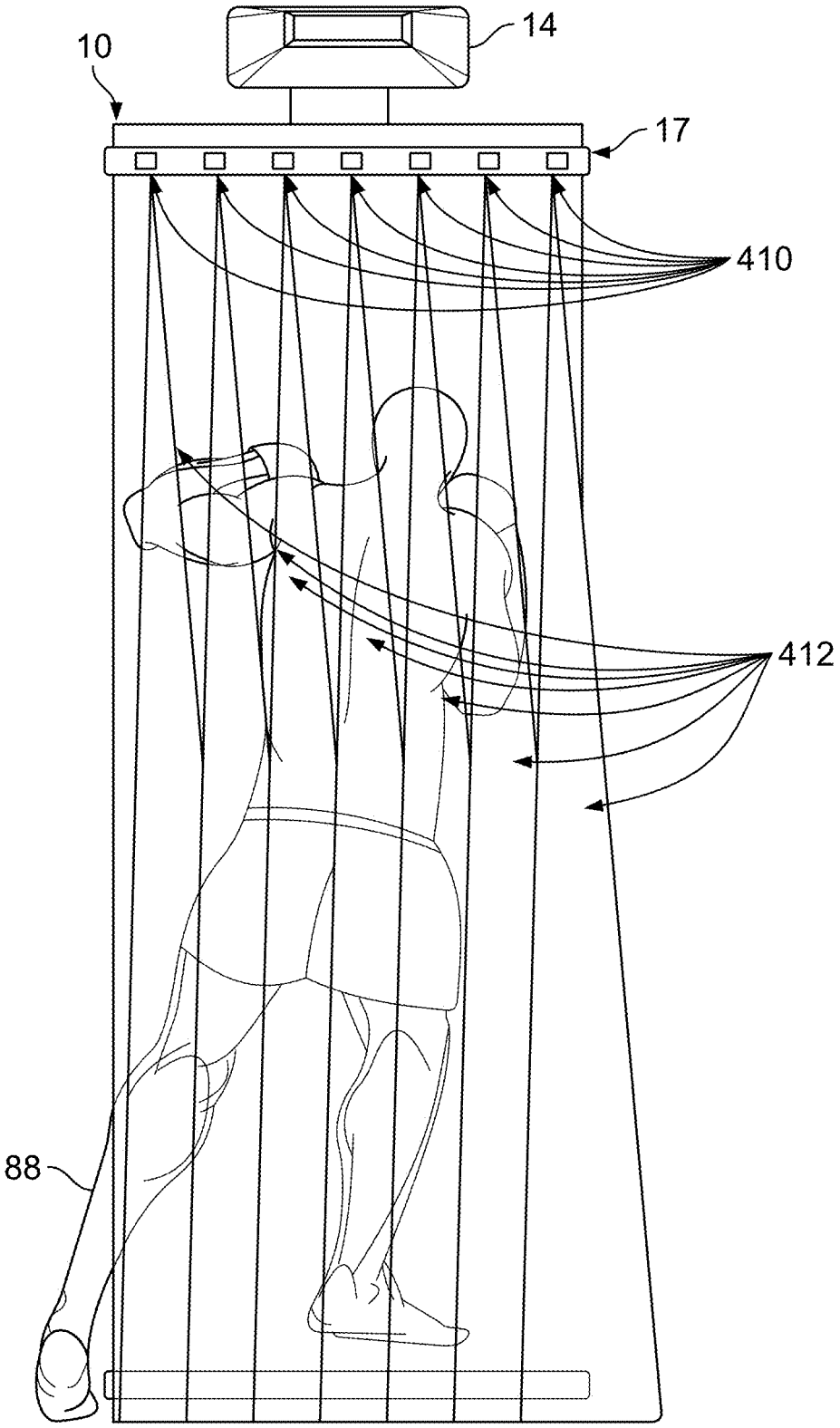
FIG. 4 is a representation of a sensing of movement and/or strikes of the user by the system of FIG. 1.

As shown in FIG. 4, each sensor 410 has a corresponding field-of-view 412 such that the corresponding sensor may detect and generate data about strikes and/or movement of the user 88 occurring in its corresponding field-of-view 412. Even though only sensors 410 disposed on the upper bent member 17 are depicted, the sensors 410 disposed on the lower bent member 19 and the mounting arm 14 also have corresponding field-of-views and operate in a similar manner than the sensors 410 depicted on FIG. 4. In some implementations, a number and placement of the sensor 410 may be determined by determining settings characteristics of the sensors 410 as described herein after (see FIGS. 7 and 8) in the present disclosure.

Figure 5:
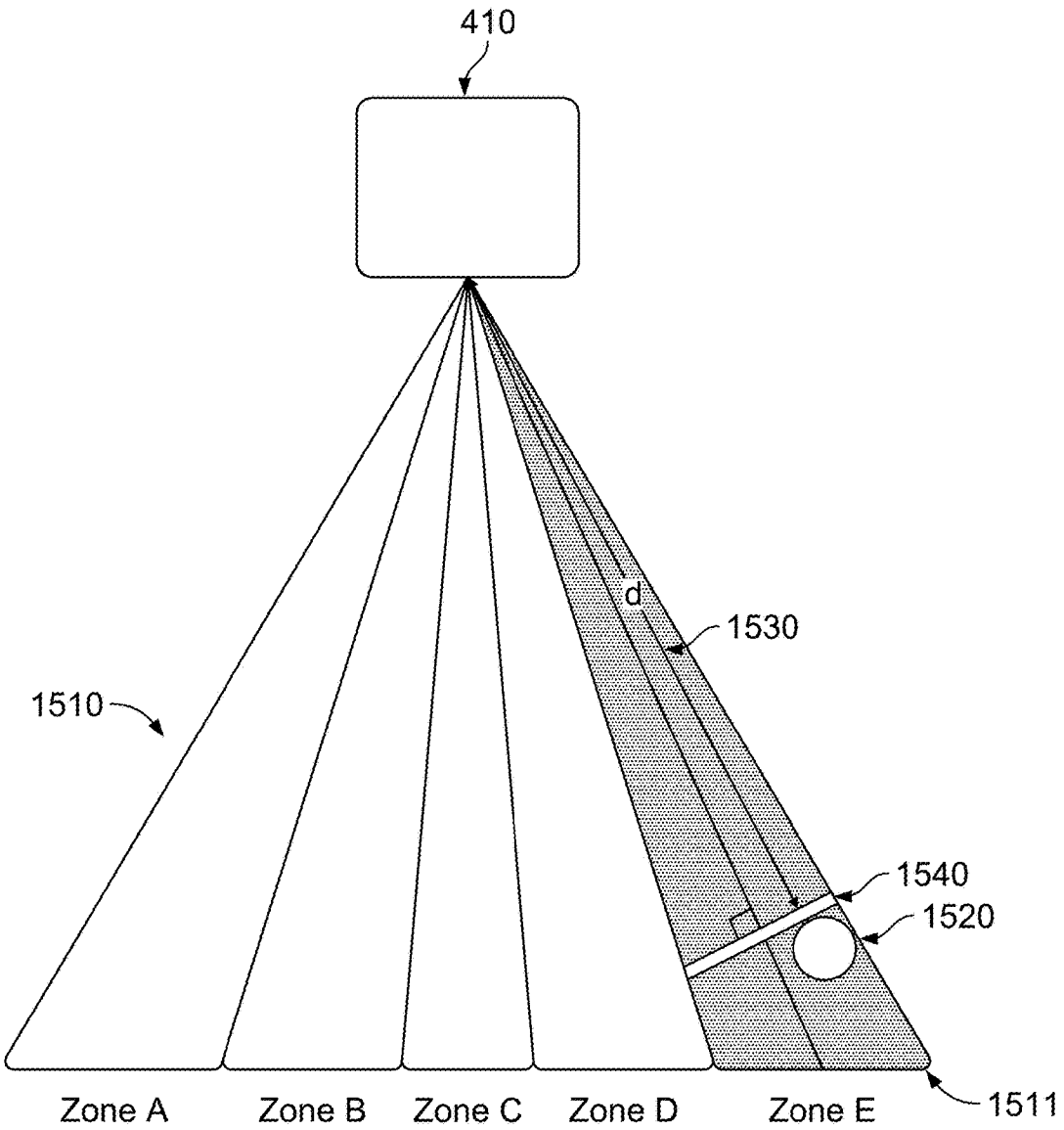
FIG. 5 is a schematic representation of a field-of-view of a sensor of the system of FIG. 1.

FIG. 5 is a schematic representation of a field-of-view 412 of a given sensor 410. The given sensor 410 may, for example and without limitation, a VL53L5CX sensor by STMicroElectronics™. In this implementation, the sensor 410 is a multizone sensor that may distinguish detections of objects occurring in a plurality of zones 1510. In this implementation, the field-of-view of the given sensor 410 includes five zones 1510 denoted "zone A", "zone B", "zone C", "zone D" and "zone E". More specifically, each zone 1510 is a three-dimensional (3D) angular portion of the field-of-view of the sensor 410. In the situation where an incoming object 1520 enters the field-of-view, the sensor 410 may determine a distance d between the sensor 410 and the object 1520 and an "active" zone 1510 in which the object 1520 has been detected (in this example said zone is zone E). The sensor 410 may transmit information about said distance d to the computing unit 105 and indication of the active zone. A precision of the sensor 410 about a position of the object 1520 is thus limited to a number and size of the zones 1510. In other words, the sensor 410 may not determine where the object 1520 is within the zone E in this example. At most, the sensor 410 may determine a 3D surface 1540 of the active zone on which the object is expected to be located, the 3D surface 1540 including points of the active zone located at a distance d with respect to the sensor 410. This may lead to inaccuracy in determining position of the object 1520.

Figure 6:
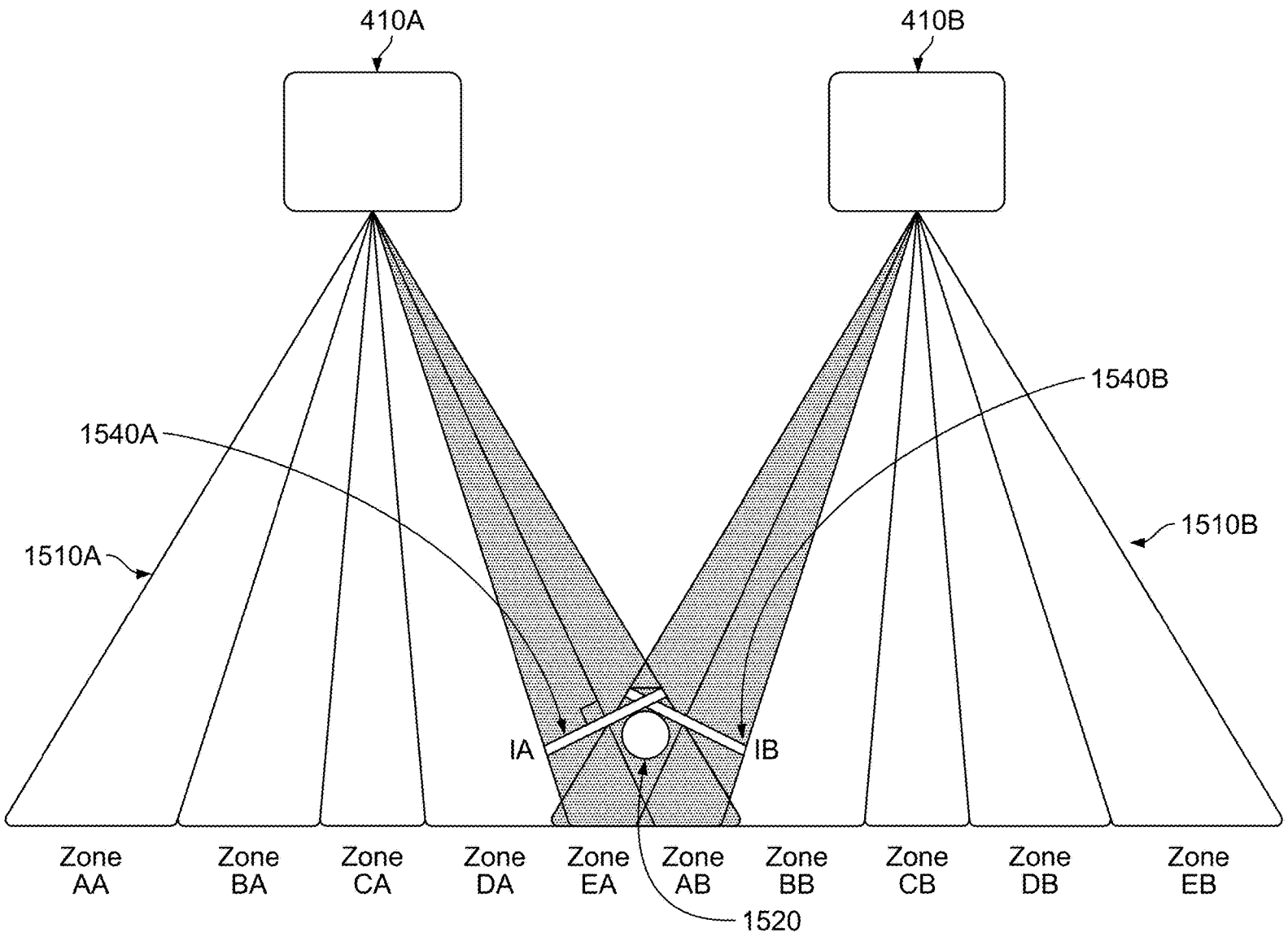
FIG. 6 is a schematic representation of overlaps between field-of-views of two sensors of the system of FIG. 1.

Developers of the present technology have devised a system for increasing an accuracy of object detection by the system 99. With respect to FIG. 6, a first and a second sensor 410A and 410B are provided to mitigate the aforementioned inaccuracy of object detection. In this implementation, the field-of-views 412A, 412B of the first and second sensor 410A, 410B respectively overlap with one another by a given overlapping factor. Said overlap factor may depend on characteristics of the first and second sensors 410A, 410B (e.g. solid angle of the field of views) and respective positions thereof. As shown in FIG. 4, the sensors 410 are disposed such that at least two consecutive sensors 410 along the outer non-planar surface 13 of the punching 10 overlap with one another. The overlap factor between two similar sensors 410 (e.g. having same electromechanical properties) may be, for example and without limitation, defined by a portion of their field-of-views overlapping at a distance of one meter when their respective optical axes are parallel with one another. As an example, in the context of the present disclosure, an overlapping factor of 0.5 between two given sensors 410 may indicate that fifty percent of the field-of-views of the two given sensors 410 overlap at a distance of one meter.

Returning to FIG. 6, the first and second sensors 410A, 410B are, in this illustrative example, consecutive sensors along the outer non-planar surface 13. In the situation where the object 1520 is located within an overlap of the field-of-views 412A, 412B, both of the sensors 410A, 410B determine a corresponding 3D surface 1540A, 1540B respectively in a respective active zone of their field-of-views. Data from both sensors 410A, 410B is received by the computing unit 105 that may determine a position of the object 1520 at an intersection of the 3D surfaces 1540A, 1540B, which increase an accuracy of the detection of the object 1520. Broadly speaking, an object that may be detected by multiple sensors 410 simultaneously enable the system 99 to detect a position of said object with an increased accuracy.

As an example, a first sensor 410 may generate first data about a first strike, the first sensor having a corresponding first field-of-view, A second sensor 410 may generate second data about a second strike, the second sensor having a corresponding second field-of-view, the first and second sensors having their respective field-of-view overlapping with one another on at least portions of the first and second field-of-views. In response to identifying the first and second strikes as being a same strike, the computing unit 105 may generate a corrected data about the strike based on information provided by the first and second sensors and relative positions of the first and second sensors.

Although description of FIGS. 4 and 5 is related to a multizone sensor 410, the same applies to for any distance sensors 410 (multizone and non-multizone) that may estimate a distance between an incoming strike of the user 88 and the outer non-planar surface 13 of the punching bag 10 such as ultrasonic sensors, infrared distance sensors, laser-ranging sensors, time-of-flight sensors or a combination thereof. Another number of sensors 410 (e.g. three) may also be used to increase accuracy of the detection of the object 1520. Moreover, a detection of an object by the sensor may include tracking of the object by the sensor in the context of the present disclosure.

In an aspect, the system 99 may detect and localize incoming strikes, namely detecting and localizing strikes before they reach the outer non-planar surface 13 and enter in physical contact with the punching bag 10. The sensors 410 may thus be referred as "contactless" sensors 410, as they effectively perform contactless strike detection and localization. More specifically, the computing unit 105 may estimate position of an expected point of impact of a given strike on the punching bag 10, or "candidate point of impact", based on data provided by the sensors 410 about a movement of the user 88. Determination of the candidate point of impact may be made before the corresponding strike actually reaches the punching bag 10. For example, based on the aforementioned object detection applied to detection of a strike, the computing unit 105 may, using data provided by the sensors 410, determine a speed of the strike, an acceleration of the strike, a trajectory of the strike and/or any other information suitable for characterizing the strike before the strikes physically interact with the punching bag 10. Position of the candidate point of impact of a given strike may be used in calculations made by the computing unit 105 (e.g. for determining exercise performance metrics) before the strike physically interact with the punching bag 10, which may increase a response-time of the system 99 for the given strike and provide a more immersive experience to the user. Information about an actual point of impact of the strike may be further used to correct information about the candidate point of impact once the strikes has effectively entered in contact with the punching bag 10.

In the same or another implementation, data generated by a plurality of sensors may be collaboratively used to determine a position of a given strike (e.g. using triangulation techniques). Broadly speaking, data generated by the sensors may include, for a given strike, information about a location of the given strike on the outer surface of the punching bag, a speed of the given strike, an acceleration of the given strike, a trajectory of the given strike; and/or a force of the given strike (e.g. using a force sensor 410*f*).

In an aspect, the present technology provides a zone of interest to limit unnecessary object detection to optimize a time-response of the system 99. FIG. 7 illustrates a side view of a 3D zone or interest 1630 defined by the system 99. In this implementation, the sensors 410 (only one of which being depicted for clarity of FIG. 7) are configured to detect objects and movements thereof in the 3D zone of interest 1630. Limiting generation of data to objects within the zone of interest may help in reducing an amount of unnecessary object detection that do not pertain to the fitness activity performed by the user 88. For example, if a cat (or any object or animal) is detected behind the user 88 outside of the 3D zone of interest 1630, it may be desirable to not generate thereabout in order to optimize a computing time of the computing unit 99 and thus, a time response of the system 99.

The system 99 may define the 3D zone of interest 1630 by performing a calibration procedure prior to any activity of the user 88. The calibration procedure may be, for example and without limitation, performed by the system 99 at a startup thereof. More specifically, during the calibration procedure, the computing unit 105 causes the sensors 410 to acquire distance measurements for objects that can be detected. It can be said that said distance measurements enable the system 99 to obtain a 3D understanding of a position thereof, namely a position of the punching bag 10, the ground surface 32 and any potential obstacles that could be in the field-of-views of the sensors 410. In use, the distance measurements may be used by the computing unit 105 to generate a 3D map of an environment of the punching bag 10.

The computing unit may further determine boundaries of the 3D zone of interest 1630 within the 3D map. In this implementation, boundaries of the zone of interest are determined based on a geometry and a position of the outer non-planar surface 13 of the punching bag 10 within the 3D map. For example, the 3D zone of interest 1630 may be a projection of a pre-determined portion of the outer non-planar surface 13 within the 3D map, thereby defining a 3D volume. Broadly speaking, the 3D zone of interest 1630 may include a "useful" vicinity of the outer non-planar surface 13, meaning that any object entering the 3D zone of interest 1630 may be detected by the sensors 410 whereas objects outside of the 3D zone of interest 1630 may not be detected (i.e. no data about said object is generated) by the sensors 410.

In this implementation, the computing unit 105 compares the acquired distance measurements to reference distance measurements stored for example in a database 102 thereof. The computing unit 105 may further generate information about a current disposition of the sensors 410 based on the comparison of the acquired distance measurements with reference distance measurements and determine the 3D zone of interest 1630 based on the current disposition of the sensors 410.

In some implementations, determining the 3D map of the environment of the outer non-planar surface 13 and the 3D zone of interest 1630 at startup may be used to mitigate any age-related deformation of the punching bag 10 or any manufacturing-related variations in the positioning of the sensors 410 relatively to the punching bag. Alternatively, a static zone of interest may also be pre-defined independently from the environment of the outer non-planar surface 13.

In use, the computing unit 105 defines active portions 413 of the field-of-views 412 of the sensors 410 by intersecting the field-of-views 412 with the 3D zone of interest 1630, objects that do not enter the active portions 413 being ignored by the sensors 410.

FIG. 8 illustrates a perspective view 802 and a top view 804 of the 3D zone of interest 1630 defined by the system 99. Developers of the present technology have realized that it may be desirable to increase an accuracy of the detection of the strikes in a given portion of the vicinity of the outer non-planar surface 13. For example, for a boxing-related fitness experience, it may be desirable to increase said accuracy on an upper portion of the punching bag 10, given that most of the strikes are expected to be applied by the hands of the user 88.

To do so, a critical portion 750 is defined by the computing unit 105 on the non-planar surface 13. Information about the critical portion 750 may be stored in the database 102. A shape and size of the critical portion 750 may depend, for example and without limitation, on the fitness activity performed by the user 88. A corresponding critical 3D zone of interest 752 may further be determined based on the critical portion 750. In the illustrative example of FIG. 8, the critical 3D zone of interest 752 is a portion of the zone of interest 1630, the critical 3D zone of interest 752 being a projection of the critical portion 750 in the 3D environment of the punching bag 10.

As described herein above, a precision of the object detection by the sensors 410 may be adjusted based on overlapping factors of the sensors 410. In this implementation, at least two sensors 410 have their corresponding field-of-views overlapping with one another in the critical 3D zone of interest 752 and on the critical portion 750.

A plurality of sensors 410 (e.g. four sensors 410) may have their corresponding field-of-view overlapping with one another in the critical 3D zone of interest 752 and on the critical portion 750 to increase accuracy of the object detection in a vicinity of the critical portion 750. In some implementation, an input precision criterion indicative of a maximal distance between an estimated position of a strike determined by the sensors 410 and an actual position of the strike on the critical 3D zone of interest 752 may be accessed by the computing unit 105 or another computing unit distinct from the computing unit 105 and, for example, dedicated for determining setting characteristics of the sensors 410 based at least in part on the input precision criterion. The computing unit may this determine a target overlapping factor of the sensors 410 in the critical 3D zone of interest 752 based on the input precision criterion. The computing unit 105 may further determine settings characteristics of the sensors 410 based on the input precision criterion, the 3D geometry of the outer non-planar surface 13 and electromechanical properties (e.g. field of view, accuracy) of the sensors 410. The settings characteristics of the sensors 410 include information about a type, a number and respective target positions with respect to the punching bag 10 of the sensors 410. In this implementation, the setting characteristics are determined such that an accuracy of the detection of objects in the critical 3D zone of interest 752 satisfies the input precision criterion.

FIG. 9 is a flow diagram of a method 800 for determining setting characteristics of the sensors 410 that determine localization of strikes of the user 88 on the outer non-planar surface 13 of the punching bag 10 according to some implementations of the present technology. In one or more aspects, the method 800 or one or more steps thereof may be performed by a processor or a computer system, such as the computing unit 105, or another computing unit distinct from the computing unit 105 and dedicated for determining setting characteristics of the sensors 410. The method 800 or one or more steps thereof may be embodied in computer-executable instructions that are stored in a computer-readable medium, such as a non-transitory mass storage device, loaded into memory and executed by a CPU. Some steps or portions of steps in the flow diagram may be omitted or changed in order.

The method 800 includes identifying, by the computing unit at operation 810, a critical portion of the outer non-planar surface and a critical corresponding 3D zone of interest.

The method 800 further includes accessing, by the computing unit at operation 820, information about 3D geometry of the outer non-planar surface 13.

The method 800 further includes accessing, by the computing unit at operation 830, information about candidate positions for the sensors 410.

The method 800 further includes accessing, by the computing unit at operation 840, an input precision criterion indicative of a maximal distance between an estimated position of a strike determined by the plurality of sensors and an actual position of the strike on the critical corresponding 3D zone of interest.

The method 800 further includes determining, by the computing unit at operation 850, setting characteristics of the sensors 410. The setting characteristics include a type of the sensors 410 (e.g. distance sensors, or cameras), a number of sensors 410, a position of overlaps between field-of-view of the sensors 410, a number of said overlaps, an overlap factor for each combination of two sensors 410 and/or respective target positions of the sensors 410, the target positions being selected among the candidate positions.

To do so, the computing unit may employ at least one electromagnetic wave propagation simulation algorithm such as a ray-tracing simulation algorithm, a soundwave propagation algorithm, and/or a multipath propagation algorithm.

The method may further include transmitting the setting characteristics to an operator of the system 99 such that the sensors 410 may be implemented according to the determined setting characteristics in the system 99.

While the above-described implementations have been described and shown with reference to particular steps performed in a particular order, it will be understood that these steps may be combined, sub-divided, or re-ordered without departing from the teachings of the present technology. At least some of the steps may be executed in parallel or in series. Accordingly, the order and grouping of the steps is not a limitation of the present technology.

In some implementations, the system 99 further includes a biometric sensor communicably connected to the computing unit 105 and worn by the user 88 for acquiring biometric data about the user 88. For example, the biometric sensor may be a smart wearable device that measure a calorie burn count, maximum heart rate, average heart rate, skin temperature, respiration rate or any other biometric data. Raw and/or processed biometric data may be displayed to the user 88 through the image projecting device 16. The biometric data may be used for subsequent analysis to further evaluate an overall health of the user 88 and for recommending subsequent workouts to the user 88.

The biometric sensor may be worn by the user in various ways. For example, a user may wear a biometric sensor on her/her wrist and/or around her/his waist. A user may wear multiple biometric sensors, which, in some instances, may be tailored to measure certain biometric data at certain locations on the user's body. Any biometric sensors may be coupled to the computing unit 105 wirelessly using various communication protocols including, but not limited to Bluetooth, ANT+, 802.1 1a, 802.1 1b, 802.1 1g, 802.11h, and 802.1 lac, either directly or via a smart phone or wireless router.

Image Projecting Device and Content

FIG. 10 is a perspective view of the system 99 with the image projecting device 16 projecting a content in accordance with some non-limiting implementations of the present technology. In this implementation, the content is a dynamic content that may be dynamically adjusted by the image projecting device 16 based, for example and without limitation, on data provided by the sensors 410. In this implementation, the outer non-planar surface 13 is white to improve a rendering quality of the dynamic content projected thereon.

Broadly speaking, the dynamic content may be a linear content (e.g. a video file), an interactive content (e.g. a video game), performance statistics including information about exercise performance metrics of the user, a leaderboard or a combination thereof. As shown on FIG. 10, the dynamic content is, in this non-limitative example, a human-size representation 18 of a coach or a sparring partner. Furthermore, the dynamic content is a boxing-related content in this example. In use, the image projecting device 16 may display dynamic content on the outer non-planar surface 13 of the punching bag 10 such as, for example and without limitations, a human-size representation 18 of a coach or a sparring partner, strike targets, or "items" 20, performance statistics, workout objectives, workout guidance, a leaderboard 24. In this implementation, a portion of the dynamic content may be displayed on the wall 30 or other surfaces beyond the outer non-planar surface 13 of the punching bag 10. In the illustrative example of FIG. 10, the leaderboard 24 is projected on the wall 30. The dynamic content and a dynamic adjustment thereof are described in greater details herein after.

In this implementation, the image projecting device 16 is an ultra-short-throw projector or the like, and is supported by the mounting arm 14. In use, the image projecting device 16 is disposed at a distance d between 40 and 86 centimeters from the wall 30, and at a height h below 70 centimeters above the upper portion of the punching bag 10. These dimensions may be adjusted or modified in alternative implementations. The image projecting device 16 may thus project the dynamic content while being placed at a safe distance and away from the strikes of the user 88. As such, the image projecting device 16 projects the dynamic content from above a head of the user 88 and onto the outer non-planar surface 13 while being close enough to the punching bag 10 such that the user 88 is not expected to be in a way of the projected light.

As previously described, the image projecting device 16 may also project content on the wall 30 on a left side and a right side of the punching bag 10, allowing for example the display of primary information (for example, coach or gamified environments) on the punching bag 10 along with secondary information, for example, such as ranking, real time & processed statistics, face-off on-line competitor or live coach on the wall 30. Illustrative examples of dynamic content are described in greater details herein after.

In this implementation, the image projecting device 16 include a laser-based light engine, a DMD chip, a DLPC chip, an optical pathway and a DMD-controller board. The image projecting device 16 has a throw ratio between 0.19 and 0.35, the throw ratio being defined by a size of a projected image with respect to a horizontal distance between a lens of the image projecting device 16 and the outer non-planar surface 13 onto which said image is projected. The image projecting device 16 has a high-image definition (e.g. Full HD-1080p), a relatively high level of brightness (1,000 ANSI lumens or over), a latency below 50-60 ms, a contrast ratio above 1500:1 and a weight below 10 kg. In some implementations, the image projecting device 16 may be an "off-the-shelf" USTP, such as the XIAOMI MI LASER 150 PROJECTOR with ultra-short-throw ratio of 0.233.

In an aspect, the dynamic content is adapted to be projected on the outer non-planar surface 13 of the punching bag such that the user 88 sees the dynamic content with limited distortion. To do so, an image distortion correction is applied to the dynamic content to mitigate deformation induced by the non-planar surface 13 on projected content thereon. The image distortion correction may be performed by the computing unit 105 as a "pre-processing" of the dynamic content before transmitting the pre-processed content to the image projecting device 16 for projection on the outer non-planar surface 13, or by the image projecting device 16.

In this implementation, the image distortion correction is based on known position of the image projecting device 16 relatively to the punching bag 10, and a 3D geometry of the outer non-planar surface 13. More specifically, using 6D positions (location and orientation) of the image projecting device 16 and the punching bag 10, and a combination of forward kinematics and raytracing, the computing unit 105 may determine an image distortion that naturally appears on content projected onto the outer non-planar surface 13 due to its non-planar aspect. The computing unit 105 may further perform reverse kinematics computations to determine a geometric image transformation to be applied to the dynamic content (i.e. how an input frame should be transformed in order to appear undistorted on the outer non-planar surface 13). The geometric image transformation applied to the dynamic content upon being projected results in the dynamic content appearing undistorted onto the outer non-planar surface 13 of the punching bag 10.

It should be noted that the geometric image transformation may be determined before deployment or usage of the system 99. Furthermore, the geometric image transformation may be determined by another computing unit distinct from the computing unit 105 of the system 99. For example, the geometric image transformation may be loaded into a memory of computing unit 105 and further be applied in real time to image frames constituting the dynamic content upon being transmitted to the image projecting device 16 in order for said image frames to appear undistorted on the outer non-planar surface 13. These computations may be accelerated by a GPU of the computing unit 105. Alternatively, the geometric image transformation may be directly loaded into a memory of the image projecting device 16 and applied to the image frames constituting the dynamic content upon projection thereof.

In this implementation and as best shown on FIG. 10, the system 99 further includes an array 12 of light emitting devices disposed on an outer edge of the punching bag 10 and communicably connected to the computing unit 105. In use, the array 12 projects light on the wall 30. The array 12 provides varying ambient light conditions that may be adjusted by the computing unit based on data provided by the sensor 410, the dynamic content currently projected onto the outer non-planar surface 13 and/or current ambient light conditions around the punching bag 10 (e.g. using a lighting measurement device communicably connected to the computing unit 105). For example, the computing unit 105 may cause the array 12 to change a color and intensity of the emitted light in response to a force of a strike of the user 88 being above a predetermined threshold. As another example, the computing unit 105 may cause the array 12 to reduce the intensity of the emitted light in response to current brightness of ambient light around the punching bag being below a pre-determined threshold (e.g. at night). The light emitting devices may be connected to and controlled by an independent micro-controller, which may engender communication via cables or may be wireless, for example, via communication standards such as Bluetooth or NFC.

In this implementation, the array 12 is a Light-Emitting-Diode (LED) array 12 including 12V Red-Blue-Green-White (RGBW) LED strips. A given LED strip may include, for example and without limitation, a density of LEDs between 40 and 144 LEDs per meter. The colors (i.e. wavelengths) and corresponding respective amplitudes may be adjusted by the computing unit 105 to provide optimized viewing of the projected dynamic content on the punching bag 10 surface and may automatically adjust for changing ambient light conditions. In use, the array 12 may include an enclosure for placing the light emitting devices therein. The enclosure may be opaque, made of plastic container and define a light-diffusing pattern on a frontside thereof. Additionally, the LEDs may be addressable individually or in small groups/patterns to improve, for example, immersivity and ambient light mitigation.

Forming a User Interface

In one aspect, the present technology provides a graphical user-interface (GUI) for physical interaction with the user 88, the graphical user-interface being formed by the 13, the dynamic content and the sensors 410. More specifically, in use, the sensors 410 generate data about an interaction (e.g. strikes) of the user 88 with the outer non-planar surface 13 such that the computing unit 105 may determine, based on the currently projected dynamic content and the current position of the strike (or incoming strike) of the user 88, a interaction between the user 88 and the system 99. In other words, the combination of the sensors 410 and the dynamic content projected by the image projecting device 16 converts the outer non-planar surface 13 into a tactile interface. It may thus be said that the dynamic content is an interactive content. The computing unit 105 may thus adapt the dynamic content in response to data received from the sensors 410 about the interaction of the user 88 with the system 99.

For example, the dynamic content may include two items projected by the image projecting device 16, a first item being located on the upper portion of the outer non-planar surface 13, and a second item being located on the lower portion of the outer non-planar surface 13. In response to determining, based on data provided by the sensors 410, that the user 88 has applied a strike on the upper portion of the punching bag 10 or that the strike enters a vicinity of the first item, the computing unit 105 may identify that the user 88 has expressed a desire to interact with the first item. In response to determining, based on data provided by the sensors 410, that the user 88 has applied a strike on the lower portion of the punching bag 10 or that the strike enters a vicinity of the second item, the computing unit 105 may identify that the user 88 has expressed a desire to interact with the second item. The computing unit 105 may further adjust the dynamic content accordingly based on, for example and without limitations, pre-determined decision trees, machine learning algorithms or any other decision process suitable for providing the fitness experience to the user.

For example, the computing unit 105 may execute a machine learning algorithm to dynamically adjust the dynamic content projected by the image projecting device 16 based on at least one of the data provided by the sensors 410.

In some implementations, interaction of the user 88 with the system may be determined based on a movement of the user 88 in front of the punching bag 10 instead of or in addition to the detection of strikes applied onto the punching bag 10. For example, in response to determining, based on data provided by the sensors 410, that the user 88 has swiped his hand upward (or any other pre-determined movement), the computing unit 105 may identify that the user 88 has expressed a desire to interact with the first item. In response to determining, based on data provided by the sensors 410, that the user 88 has swiped his hand downward (or any other pre-determined movement), the computing unit 105 may identify that the user 88 has expressed a desire to interact with the second item.

Broadly speaking, the user 88 may be able to directly interact with the GUI by pressing on the outer non-planar surface 13 where items are displayed to interact with said items, or entering in a vicinity of said items (e.g. by approaching his hand at a distance below 5 cm). This may also be done for displays on the wall 30. The sensors 410 may for example determine where the user 88 has pressed the surface of the bag and therefore which item the user wishes to interact with at any given time.

In this implementation, the user 88 may interact with the interactive content by using fighting gloves. A size of the items may be, for example and without limitation, between 3 cm and 50 cm.

Sensor Calibration Using the User Interface

Developers of the present technology have also realized that intrinsic optical properties of the sensors 410 may tend to slightly vary from one manufacturer to another and may be the source of imprecisions. To address this source of imprecisions, the present technology provides a sensor calibration procedure. FIG. 11 is a flow diagram of a method 1100 for executing a sensor calibration procedure of the sensors 410 of the system 99 according to some implementations of the present technology. In one or more aspects, the method 1100 or one or more steps thereof may be performed by a processor or a computer system, such as the computing unit 105. The method 1100 or one or more steps thereof may be embodied in computer-executable instructions that are stored in a computer-readable medium, such as a non-transitory mass storage device, loaded into memory and executed by a CPU. Some steps or portions of steps in the flow diagram may be omitted or changed in order.

The method 1100 includes causing, by the computing unit 105 at operation 1100, display of one or more items at pre-determined locations on the outer surface 31, the one or more items being provided to the user 88 with indications leading the user to apply strike on the outer surface at the pre-determined locations of the one or more items. Said indication may be for example a symbol of a target and/or a "HIT" message displayed on the item.

The method 1100 further includes determining, by the computing unit 105 at operation 1120, present locations of strikes (or incoming strikes) applied by the user in response to the displaying of the one or more items based on data received from the sensors 410.

The method 1100 further includes determining, by the computing unit 105 at operation 1130, an error-correction parameter of the sensors 410 by comparing the pre-determined locations of the one or more items with the present locations of the applied strikes (or incoming strikes). The error-correction parameter may be indicative of and/or proportional to a distance between the pre-determined locations and the present locations of the applied strikes (or incoming strikes). In this implementation, the error-correction parameter is also indicative of a direction of said distance along the outer non-planar surface 13.

The method 1100 further includes adjusting, by the computing unit 105 at operation 1140, a calibration of the sensors 410 based on the error-correction parameter. For example, in response to the error-correction parameter being indicative of the strikes of the user 88 being in average located on a left side of the projected items, the calibration of the sensors 410 may be adjusted such that the sensors 410 shift the determined position of the strikes (or incoming strikes) by a certain value on the right The sensor calibration procedure may be said to be a semi-automatic procedure, as the procedure involves interaction of the user 88. Broadly speaking, the sensor calibration procedure may be used to determine intrinsic parameters of the sensors 410 and apply error-correction to calculations for improved precision.

In one implementation, the computing unit 105 may also compare 3D positions of an incoming strike at regular intervals to determine an average approach speed of the incoming strike of the user 88.

While the above-described implementations have been described and shown with reference to particular steps performed in a particular order, it will be understood that these steps may be combined, sub-divided, or re-ordered without departing from the teachings of the present technology. At least some of the steps may be executed in parallel or in series. Accordingly, the order and grouping of the steps is not a limitation of the present technology Content As previously described, the dynamic content may be a linear content, an interactive content, performance statistics comprising information about exercise performance metrics of the user, a leaderboard or a combination thereof.

Linear content may include pre-recorded or live classes where a main content (i.e. the human-size representation 18 of a coach or a sparring partner, timers, performance statistics, guidance, objectives) is projected onto the outer non-planar surface 13 and a secondary content is displayed on the wall 30 (e.g. the leaderboard 24, guidance, objectives and statistics).

Linear content may include on-demand classes available to the user 88 through a library of previously recorded classes or live classes retrieved by the computing unit form the Internet for example. Linear content may allow the user 88 to take a class with a boxing or fitness coach imaged under the form of the human-size representation 18, or simply "coach 18", on the outer non-planar surface 13. The user 88 may thus observe, follow, interact, and reproduce or respond to the movements of the coach for the different fitness exercises to be performed during a class. Interaction of the user 88 with the linear content is assessed using data provided by the sensors 410, said data being further used by the computing unit 105 to generate the exercise performance metrics of the user 88. Broadly speaking, linear content is a dynamically adjusted content relying on information from the sensors 410 as input for generation of the exercise performance metrics and exchange of information between the user 88 and the system 99. For example, data provided by the sensors 410 might be used by the computing unit 105 to determine a strength and a localization of a strike of the user 88. Based on said localization a precision of the strike may be determined by the computing unit 105 by comparing the strike with a localization of an item projected on the punching bag 10 by the image projecting device 16 for example. Strength and localization precision, may form, among other metrics, the exercise performance metrics. The computer unit 105 may dynamically adjust the linear content by overlaying effects visual effects onto the original class video. For example, the visual effects may include colored explosion effects that may be of a first color in response to the strength of the strike being below an expected strength, and of a second color in response to the strength of the strike being above the expected strength. In this implementation, the visual effects projected on the punching bag 10 are selected among a set of visual effects based at least in part on the exercise performance metrics of the user 88. This may provide a direct indication to the user 88 about how well the user 88 is performing while attending the linear content.

It should be noted that the coach 18 may be a representation of an actual person being recorded by an imaging device (e.g. a camera). The computing unit 105 receives a stream of data from the imaging device and cause the image projecting device 16 to display the representation of the person as the person is currently, thereby providing a real time and remote fitness experience shared between the user 88 and said person.

For example, two separate types of linear classes may be produced. A first type of linear classes is fitness classes, that are oriented towards physical effort rather than technicality and offer a similar experience to that of a physical boxing fitness studio class (e.g. Rumble Boxing, Title Boxing Club). As illustrated in FIGS. 12A and 12B, in this scenario, the coach 18 does not wear gloves and performs the movements in the same way the user would be expected to and is displayed across the surface of the punching bag 10. Users may replicate the form and movements of the coach 18 as the coach is being displayed on the outer non-planar surface 13. Items 1310 projected as visual aids (through the form of, for example, white lines and shapes to show the movement and location of the strikes) may be included in the dynamic content of the class to augment the movements made by the coach and simplify their reproduction by the user. As well, verbal instructions and encouragement/corrections may be provided in a variety of languages to enhance the experience. In some implementations, the items 1310 may vary according to movements and/strikes of the user 88. More specifically, the computing unit 105 may adjust a shape, a color, a brightness or any other visual variable of the items based on data provided by the sensors 410. For example, a given item 1310 that may initially be white may turn green after the user 88 has correctly performed the strike or red if the strike was missed by the user 88. The shape of the item 1310 may also give various information to the user 88, such as time remaining to perform the strike with a circular visual aid that is gradually getting smaller as time goes by.

A second type of linear classes is technical classes, that are oriented towards a technical workout and offer a similar experience to that of an individual training session with the coach 18 wearing mitts. As illustrated in FIG. 13, the coach 18 displayed on the outer non-planar surface 13 may wear boxing mitts 1410 to indicate where and what types of strikes are expected to be thrown by the user 88. The coach 18 may dedicate the class to learning specific boxing strikes, combinations, movements and/or techniques. The user 88 may follow the instructions of the coach projected onto the outer non-planar surface 13 and perform the movements expected by, for example, punching at the mitts 1410 held by the coach 18.

Interactive content may include interactive items (such as the human-size representation 18 of a coach or a sparring partner, gamified environments, digital shapes and forms, etc.) with which the user 88 physically interacts with and receive instantaneous, digital feedback based on his/her interaction with said content on the outer non-planar surface 13 of the punching bag.

Interactive content may consist of content relying on information from the sensors 410 as input for interactivity and exchange of information between the user 88 and the system 99. With real time information of the user 88 available from, for example, the sensors 410, there may for example be four main types of interactive content that may be provided: 1) AI-coaching; 2) Interactive games; 3) Interactive drills; and 4) Interactive sparring.

AI-coaching may offer personalized, real-time feedback to the user 88 to help the user 88 to improve and reach maximum effort during a workout by providing advice on form, posture, movements as well as encouragements during a class. An 'entertainment' AI mode could also be provided to a plurality of users 88 of the same system 99 by comparing a force of a strike for each of the users 88. Many other such AI-interactive approaches may be designed with the sensors and computation power available.

Interactive games may offer an easily accessible, gamified boxing experience through game environments with predetermined objectives requiring little to no prior boxing experience. For example, games could be real-time, interactive rhythmic games such as those inspired from the likes of Guitar Hero, Beat Saber and Fruit Ninja. For example, as illustrated in FIGS. 14A, a user 88 may play a boxing equivalent of Guitar Hero game, or as illustrated in FIG. 14B, a user 88 may play a workout finisher game. Interactive gaming content may be for example, a multiplayer offline and/or online gaming content.

Interactive drills may provide users with a digital avatar of a person or character adapting to movements and strikes of the user 88 in real-time according to a pre-determined set of boxing drills. As well, such a digital avatar taking the form of a digital person/coach could interact with the user in real time and allow the user to practice offensive and defensive boxing moves may be provided by the system 99.

Interactive sparring may provide users with a digital sparring partner in the form of a person/boxing coach or fighter or character (e.g. the human representation 18) who could adapt to movements and strikes of the user 88 in a real-time and in a non-predetermined (or partially predetermined) way. Similarly, a digital avatar taking the form of a digital sparring partner could interact with the user in real time and allow the user to experience a fully interactive boxing and sparring experience (in a non-predetermined or partially predetermined way).

Interactive sparring on the system 99 may also provide the ability to have two people, likely but not necessarily in their respective homes at the same time, compete against one another in the form of digital avatars. The sensor 410 could capture the movements of each "player" and reproduce the moves and strikes of each player onto the display of the other. Interactive sparring content may for example be offline and/or online content.

Additionally, the dynamic content may include supporting information content indicative of current and/or past configuration and operation parameters of the system 99. For example, the dynamic content may be supported by multiple layers of secondary real-time information, which may be directly overlaid on the primary content (linear or interactive content). For example, the supporting information content may include class information, the exercise performance metrics, biometric data, the leaderboard 24 and a class summary.

Class information, for example, such as that illustrated in FIG. 15, may provide users with general information and guidance relative to a class. The class summary may include, for example and without limitation, indication of a time left before the end of the class, a number of rounds, names of exercises and written instructions. In FIG. 15, the time remaining in the current activity 1010, the time remaining for the complete workout 1021 and total number of rounds versus current round 1022, the current boxing combination to throw for the user 1030, may be projected onto punching bag 10. Alternatively, some or all of this information may instead be displayed on the wall 30.

The exercise performance metrics may provide users with the relevant statistical feedback on personal (and competitor or benchmark/target) striking performance. The exercise performance metrics may include, for example and without limitation, indication of a strike count, a strike power, a strike location and a strike timing, Biometric data may be indicative of relevant statistical feedback relative to the efficacy of the workout. The biometric data may include, for example and without limitation, indication of a calorie burn count, a maximum heart rate and an average heart rate.

The leaderboard 24 may allow the user 88 to assess his/her performance relative to other members of the class in real time. The leaderboard 24 may include, for example and without limitation, indication of a number of class participants, current ranking of user and a list of other users directly in front or behind the user at a particular point in time during a class.

Class summary may provide the user 88 with a personal and class/competitor performance summary at the class end. The class summary may include, for example and without limitation, indication of a ranking, output evolution, calories burned, strikes thrown, strike power, punch accuracy.

Social Content

In this implementation, the computing unit 105 includes a networking device 109 communicably connected to a content delivery network (CDN) 123 for receiving at least a portion of the dynamic content from the CDN. The computing unit 105 and the CDN 123 are communicatively coupled over a communication network 122 via any wired or wireless communication link including, for example, 4G, 5G, LTE, Wi-Fi, Ethernet or any other suitable connection. In some non-limiting implementations of the present technology, the communication network 122 may be implemented as the Internet. In other implementations of the present technology, the communication network 122 can be implemented differently, such as any wide-area communication network, local-area communication network, a private communication network and the like. How the communication links between the computing unit 105 and the CDN 123 are implemented will depend inter alia on how the computing unit 105 and the CDN 123 are implemented. The computing unit 105 may also, through the networking device 109, exchange real-time statistics as well as upload user data and download system updates with the CDN 123 or another network including a resource server that stores relevant information (e.g. system updates).

In use, the CDN 123 provides the computing unit 105 with an access to one or more social network platforms (e.g. INSTAGRAM, FACEBOOK, STRAVA), content streaming platforms (e.g. music streaming, movies streaming) for receiving data therefrom and transmitting data thereto, which allow the user 88 to connect to another person and to a group/community of people. For example, the dynamic content projected by the image projecting device 16 may include data received from the one or more social network platforms. The user 88 may connect to another person using a search feature integrated into the GUI. The search feature may enable the user to search for another person based on various attributes including, but not limited to their legal name, username, age, demographic, location, fitness interests, fitness goals, skill level, weight, height, gender, current injuries, injury history, and type of workout music. In one example, once the user selects another person with which they want to connect to, a request may be send to the other person for subsequent confirmation/approval. If the other person approves, the user may be connected to the other person and may see the person on a list of contacts. In some cases, the user may configure their account to automatically accept requests from other users. This may be an option selected under the settings portion of the GUI.

The GUI may also provide other methods for the user to connect to another person. For example, the user may connect to other users based on their attendance of a particular fitness class. For example, the user may register for a fitness class. Before the class begins, the user may be able to view other users attending the same class. The GUI may enable the user to select another user and send a connection request. A connection request may also be sent during or after the fitness class. The GUI may also recommend people to connect with based on the attributes described herein (e.g., the attributes may be combined to form a representation of the user) as well as other attributes including but not limited to a similar workout history, similar workout performance or progression, similar scores on a leaderboard, same or different sex, geographic proximity (e.g., based on a user's defined location, an Internet Protocol (IP) address), and/or shared connections with other users (e.g., 1st degree, 2nd degree, 3rd degree connections). The GUI may also enable the user to browse through a leaderboard and select another user shown on the leaderboard. Once the other user is selected, a connection request may be sent.

The GUI may provide a list of contacts to the user, which may be grouped and/or organized according to the user's preferences. For example, the list of contacts may be arranged based on the user's immediate family, friends, coworkers, list of instructors, people sharing similar interests, demographic, and so on. The list of contacts may also include a filter that enables the user to select and display one or more groups.

Additionally, the GUI may enable the user to join another group and/or community of users. For example, a user may create a group for users interested in a certain type of exercises or workouts. The group may be set to be a public group where any user may see the group via the GUI and may send a connection request to join the group. The group may also be set to be a private group that may not be available via the GUI and only allows users to join by an invitation. The group may be created by a user or an instructor. Other users may join the group upon approval by the creator or another user with appropriate administrative rights. In some cases, the group may be configured to accept connection requests automatically.

The group may be used, in part, to provide users a forum to communicate and share information with one another. For example, a user may provide recommendations for various fitness classes or instructors to other users. In another example, an instructor may send a message on a new or upcoming fitness class they are teaching. In another example, a user may send a message indicating they are about to begin a fitness class. The message may provide an interactive element that enables other users to join the fitness class directly, thus skipping the various navigational screens previously described to select a fitness class. Additionally, a user may post a message containing audio and/or video acquired by the system 99 to share with other users in the group. For example, a user may post a video showing their progress in losing weight. In another example, the user may show video of the instructor and/or other users participating in the fitness class. A user in the group may also generate a group-specific leaderboard to track and rank various members of the group.

In some cases, the GUI may also enable all or a portion of the users within a group to join a particular fitness class together. For example, the users within a group may form a subgroup where a designated leader of the subgroup may then select a boxing or fitness class, using similar processes described above, thus causing the other members of the subgroup to automatically join the same boxing or fitness class. The GUI may also provide live audio and/or video chat between users within the same group and/or subgroup. For example, when a subgroup of users joins a fitness class together, the GUI may allow the users of the subgroup to communicate with one another during the workout. This may include audio and video streams from other users overlaid onto the exercise displayed. It should be appreciated the subgroup may also be formed based on the user's selection of one or more contacts on their list of contacts (as opposed to being restricted to users within a group).

The GUI may also enable the user to create a social network blog to include various user generated content and content automatically generated by the system 99. User-generated content may include, but is not limited to ratings or reviews of various boxing or fitness classes, audio messages generated by the user, video messages generated by the user, interactive elements linking to one or more fitness classes. Automatically generated content may include, but is not limited to updates to the user's score on a leaderboard, achievements by the user (e.g., completing a fitness goal, badges), and attendance to a fitness class. The content shown on the user's social network blog may be designated as being public (e.g., any user may view the content) or private (e.g., only select group of users designated by the user may view the content).

The GUI may also enable the user to "follow" another user. In this description, "follow" is defined as the user being able to view another user's information that is publicly accessible including, but not limited to the other user's social network blog, workout history, and score(s) on various leaderboards. The option of following another user may be presented as another option when the user is assessing whether they want to connect to other user. Therefore, the GUI may enable the user to follow another user using similar methods described above in the context of connecting to other users.

As described herein, the system 99 may be used to share various user information with other users including, but not limited to the user's profile, social network blog, achievements, biometrics, activity selection, a video recording, and feedback. For example, user X may share their progress on a fitness routine to user Y, who may then provide feedback (e.g., an emoji, an audio message, a video message, etc.) to user X. In another example, the GUI on the system 99 or on the user's smartphone may prompt the user to take a selfie image, either with the system 99's camera or the smartphone. The camera and the display shown on the punching bag 10 and/or wall 30 may then be configured to show a live video of the user to create a desired pose. An image of the user may then be acquired (e.g., after a preset period of time or based on an input command by the user). The image of the user may then be shared with other users (e.g., in the same fitness class, in the user's list of contacts, in the user's group). The user may also view other user's images.

In another example, the sensors 410 may record a video or GIF of user X during a workout, which may then be shared with user Y. As user Y performs the same workout, the video of user X may be overlaid and displayed with a live video of user Y. The respective video recording of user X and the live video of user Y may be semi-transparent such that user Y may compare their form and/or movement to user X during the workout. In some cases, the system 99 may enable the user to download video recordings of other users and/or instructors to display onto their respective system 99 whilst performing the workout. In this manner, the system 99 may support a "ghost mode" that allows users to compare their performance during a workout to other people. For example, the user may download a video recording of multiple experts performing the same workout. The user may then display the video recording of each expert (individually or in combination) to evaluate the user's progression in the workout. The system 99 may be designed such that the user may size the images to match or auto-match size, and may also control the system 99 on overlap and contrast.

The system 99 may also support achievements. Achievements are defined as rewards given to the user upon satisfying certain criteria for the achievement. The rewards may include, but is not limited to a badge (e.g., a visual graphic the user may share with others), a number of points contributing to a user's leaderboard position (e.g. output), and access or a discount to premium content. Achievements may be given for various reasons including, but not limited to exercising several days in a row, meeting an exercise goal, completing certain types of workouts and/or exercises, completing a certain number of workouts and/or exercises, and advancing to more difficult skill levels. A summary of the achievements earned and possible may be shown on the GUI to the user, Information may be shared between users in several ways. In one example, two or more of the system 99 may share data directly with one another via local, direct connections in a scenario where the systems 99 would be connected to the same network (e.g., multiple systems 99 at a gym, hotel, or home). In another example, information may be shared via the application installed on each user's system 99 and/or smart device through a remote network connection (e.g., a wireless network, wireless internet, a telecommunication network). Information may also be stored remotely on a server, which may then be distributed between users (e.g., with or without prior manual approval of the user based on the settings of the system 99 and/or the user's account). In addition, a dedicated community section in the system 99's mobile application has been built and may be useful to users.

As described herein, the GUI may also include one or more leaderboards to rank users according to a user's score. For example, a leaderboard may be generated for each fitness class to rank the participant's performance during and after the class or activity. In another example, one or more global leaderboards may be used to rank many, if not all, users based on the type of exercise or activity or a combination of different exercises and/or activities.

The leaderboard 24 may be used, in part, to provide a competitive environment when using the system 99. Users may use their scores to evaluate their progress at a workout by comparing their current scores to their own previous scores recorded by the system 99. Additionally, one user may compete against one or more other users (e.g., globally, within the same group, within the same subgroup or individually against a selected opponent) to attain higher scores in a live setting (e.g., users within the same fitness class) or with respect to previous scores recorded by the other user(s). The user may configure the leaderboard to show other users exhibiting similar attributes including, but not limited to demographic, gender, age, height, weight, injury, location, skill level, and fitness goal. These attributes may be dependent on the user (e.g., the leaderboard includes users similar to the user) or may be entirely independent (e.g., the leaderboard includes users dependent solely on the criteria specified by the user).

The user's score on a leaderboard may be calculated in various ways. In one example, the user's score may be determined based on a user's striking statistics and output (e.g. number of strikes, power of the strikes, accuracy and timing of strikes) or a user's estimated calories burnt or heart rate during a workout.

In a use case example, a single system 99 may support multiple users performing a workout. During the workout the scores for each user may be displayed to each user. In this manner, the users may dynamically compare their scores against one another during the workout, which may provide an incentive for the users to achieve a greater workout performance compared to the case where each easer exercises on their own separately.

Mobile Application and GUI

The GUI may allow a user to, for example and without limitation, 1) Connect and pair a system 99 for the first time; 2) Pair one or more user accounts with the system 99 3) Manage multiple user accounts on a specific punching bag 10; 4) Access a selection of fitness classes; 5) Select a fitness class: 6) Start a fitness class; and 7) Interact with summary information at the end of a fitness class or other type of session or competition.

Additionally, the computing unit 105 may cause the image projecting device 16 to horizontally mirror the dynamic content depending on whether the user 88 is left-handed or right-handed. This may be done in the same way as with the height. The computing unit 105 may obtain the dominant hand information from the user upon sign up and when a user selects a class, the computing unit 105 selecting and causing projection of adapted dynamic content based on information about the user 88.

For example, the user 88 may control the system 99 using voice control via the microphones thereof. The system 99 may also be controlled using gesture commands in cases where the sensors 410 includes motion tracking sensors or by applying image analysis techniques to a video of the user 88 acquired by the sensor 410. The system 99 may also be controlled using touch commands in cases where the surface of the punching bag 10 is 'touch' sensitive (performed through the sensors 410).

In some implementations, the computing unit 105 is communicably connected to a user device 101 (see FIG. 17) such as a smartphone, a smartwatch, a tablet, a dedicated remote, a smart exercise equipment (e.g., a treadmill, an exercise bike, a smart dumbbell), or a personal computer, through a mobile application executed by the user device 101. The computing unit 105 and the user device 101 are communicatively coupled over a communication network 122 via any wired or wireless communication link including, for example, 4G, 5G, LTE, Wi-Fi, or any other suitable connection. In some non-limiting implementations of the present technology, the communication network 122 may be implemented as the Internet. In other implementations of the present technology, the communication network 122 can be implemented differently, such as any wide-area communication network, local-area communication network, a private communication network and the like. How the communication links between the computing unit 105 and the user device 101 are implemented will depend inter alia on how the computing unit 105 and the user device 101 are implemented.

The user 88 may interact with the computing unit 105 and other components of the system 99 by using the user device 101. The computing unit 105 may cause the user device 101 to display a personal GUI to facilitate user interaction with the system 99. The personal GUI may be adapted to conform to different user inputs dependent on the manner in which a user interfaces with the system 99. For example, the personal GUI on a user's smartphone may allow the user to change settings of the system 99, select/browse various fitness classes, and/or change settings during a workout.

The personal GUI may support touch commands and may be designed to accommodate the size of the display on the user's smartphone. In another example, a personal GUI on a user's computer may provide a more conventional user interface that relies upon inputs from a keyboard and/or a mouse. In yet another example, a GUI on the system 99 may provide voice or gesture prompts to facilitate user-provided voice commands and gesture commands, respectively. The personal GUI for the system 99 may be adapted to support multiple types of user inputs (e.g., a controller, a remote, a voice command, a user command).

The following description provides several examples of GUI-related features to facilitate user interaction with the system 99. These GUI-related features are categorized according to the following categories: settings, browsing and selecting a class, class interface, social networking, and background processes. These categories are used merely for illustrative purposes and that certain features may be applied under several situations that may fall under multiple categories and/or use cases. One or more of these features may be adapted and/or modified to accommodate certain user input types, The personal GUI may extend to multiple devices including, but not limited to the GUI formed by the dynamic content and the sensors 410, a smart phone, a tablet, a computer, and a remote control. It should be noted that one or more of the functions of the personal GUI may be performed by the GUI of the system 99 formed by the dynamic content and the sensors 410. FIGS. 16A to 16J illustrates GUI-related features in accordance with implementations of the present technology.

For example, FIG. 16A illustrates a home screen of a mobile application executed by the user device 101 to communicate with the computing unit 105. In this implementation, the home screen includes invitation or advertisement links for classes. In use, the user 88 may select a sparring class and access a screen illustrated in FIG. 16B showing additional details of the selected sparring class. This class may have links to the featured music/artists, class plan, target metrics, activity of the user, and a link to the leaderboard 24 for that specific class. The user 88 might additionally be able to sort through potential activities by any of these metrics, for example, such as sorting the boxing classes for specific calorie expenditures, or for what a friend or group of friends have already signed up for or indicated an interest for.

Furthermore, the user 88 might set and use filters, for example, such as are illustrated in FIGS. 16C and 16D. The filters may include but are not limited to workout type, trainer, time or length of activity, level such as by experience, qualifications, or recommendations/pre-requisites completed, music genre, type of activity (skills, games, completed, bookmarked) and so on. Additionally, a user might use the mobile application to see statistics, such as, for example, as illustrated in FIGS. 16E and 16F. The mobile application might also offer the user a rollup of lifetime statistics, such as those illustrated in FIG. 16F.

Moreover, the mobile application may include without limitation a set of profile options such as are illustrated in FIGS. 16G and 16H. For example, badges and streaks might be earned and tracked, with simple uploads to a social media app such as Facebook or Instagram. The user 88 may also be offered to earn and display badges achieved for specific skills demonstrated, outputs achieved, and classes completed. As well, there may be groups or 'tribes' organized through the system 99 and the mobile application with an overview of the tribe's community such as illustrated in FIG. 16I and specific personal tribe/group statistics and information as illustrated in FIG. 16J.

Summarily, the user 88 may, using the mobile application, May 1) Select a fitness class or game to be projected onto the punching bag 10; 2) Control video content during the projection of a class (start, pause, back, forward, navigate video sections, and so on); 3) Control sound content during the projection of a class (increase/decrease volume, balance, equalizer, and so on.); 4) Access his/her performance statistics (output, calories burned, number of strokes, force of strokes, speed, heart rate, performance over the week, performance over the month, and so on.); 5) Access his/her user profile (activity calendar, badges, achievements, challenges, and so on.); 6) Access communities (discover communities, join a community, follow the ranking of community members, and so on.); 7) Manage settings; 8) Pair one or more separate user accounts with the punching bag 10 (each punching bag 10 may have its own serial number as well); 9) Pair one or more wireless devices (for example, Bluetooth @, and so on.) with the punching bag 10.

The personal GUI may allow the user to modify and choose various settings related to the operation of the system 99. For example, the GUI may be used to initially setup a connection between a user's smart device and the system 99 (or the system 99 and a network) The personal GUI may be used to synchronize a user's smart phone to the system 99 and to connect the smart phone and/or system 99 to a network. The personal GUI may indicate the status of the connection of the smartphone and the system 99 under a settings screen. The GUI may also show the connection status of the system 99 and brightness of the display while using the personal GUI to navigate and browse for content. Additionally, the personal GUI may provide prompts to instruct the user the steps to connect the user's smart device to the system 99. Generally, the personal GUI may enable the user to manage the connectivity between the system 99, the user's smart device, a network router, and any peripheral devices (e.g., a biometric sensor or a Bluetooth audio device).

The personal GUI may also enable the user to create a user account when first using the system 99. The user account may be used, in part, to manage and store user information including, but not limited to the user's name, age, gender, weight, height, fitness goals, injury history, location, workout history, social network profiles, music or movie streaming services profiles, contact list, group memberships, ratings/reviews of fitness classes, payment and subscription information and authorization codes, and leaderboard scores. The user account may also be used to store user preferences and account settings. In this manner, the user's information may be stored remotely (e.g., on a server or a cloud service), reducing the risk of accidental data loss due to failure of the user's smart device or the system 99. The personal GUI may be configured to have the user log into their account before using the system 99. The user information may be stored without creation of a user account. For example, the user information may be stored locally on the user's smart device or elsewhere in the system 99. Depending on the user's settings, the user information may be shared with other users and/or instructors without the use of a user account.

The personal GUI may further include several settings to customize the system 99 based on the user's preferences. For example, the brightness, contrast, and color temperature (e.g., a warmer hue, a cooler hue) of the image displayed on the surface of the punching bag 10 and wall 30 of the system 99 may be manually changed in the personal GUI. In some cases, these display parameters may be adjusted automatically depending on ambient lighting conditions and/or user preferences. For example, the system 99 may include an ambient light sensor that monitors ambient lighting conditions, which may be used to adjust the display parameters according to particular criteria. For instance, the system 99 may adjust the display's brightness, contrast, color balance, and/or hue, e.g., for increasing visibility of the video content in bright ambient light or decreasing blue/green light to reduce eye fatigue and/or disruptions to sleep quality during evening hours.

The personal GUI may enable the user to change the user interface (UI) layout. For example, the personal GUI may enable the user to toggle the display of various items before, during, and after a workout including, but not limited to various biometric data (e.g., heart rate, step count, etc.), an exercise timer, a feedback survey for a fitness class or each exercise, and a calorie bar (indicating number of calories burned). Some of these options may be shown in the personal GUI. Additionally, the personal GUI may enable the user to change the color or theme of the personal GUI including a different background image, font style, and font size. The layout of the personal GUI during a workout may also be modified. For example, the size of the video content (e.g., the size of the instructor shown on the punching bag 10) may be changed based on user preferences. In some cases, the size of the instructor may also be dynamically varied, in part, to accommodate exercises captured at different viewing angles and/or different levels of magnification.

The personal GUI may also include options for the user to change their privacy settings. For example, the user may select the type of information and/or content that may be shared with other users. The privacy settings may allow users to set the level of privacy (e.g., the public, the group, the subgroup, designated contacts, or the user themselves may have access) for different information and/or content. The privacy settings may also include what type of information may be stored remotely (e.g., on a server, a cloud service) or locally on the user's smart device or the system 99

The personal GUI may also allow the user to adjust various audio settings on the system 99 (and/or a speaker peripheral connected to the system 99/the user's smart device). The audio settings may include, but is not limited to the volume of music, the volume of an instructor's voice, the volume of another user's voice, and the volume of sound effects. Additionally, the personal GUI may allow the user to select language options (e.g., text and audio) and to display subtitles or captions during a workout. The personal GUI may also allow the user to configure a prerecorded voice, which may be used to provide narration, instruction, or prompts. The gender, tone, and style of the prerecorded voice may be adjusted by the user via the personal GUI.

The personal GUI may be used to select and play music with the system 99, such as while exercising during a fitness class or while the display is off. The personal GUI may be used to connect to and select a music source, for example, such as Spotify, digital radio sources, CD collections, Amazon Music, Pandora, and so on. The system 99 may also support music downloaded locally (e.g., onto onboard storage in the system 99) and/or streamed from external sources and third-party services, as described above herein. The music may also be stored on a remote device (e.g., a smart phone) and transferred to the system 99 or speaker via a wireless or wired connection. The music may be selected independently from the activity and may be played by the system 99 or a speaker connected to the system 99 (e.g., Bluetooth speaker). Additionally, the music may be arranged and organized as playlists. The playlist may be defined by the user, another user, or an instructor. The personal GUI may support multiple playlists for the user to select during a given session with the system 99.

The personal GUI may also enable the user to navigate and browse various content available to be downloaded and/or streamed to the system 99 The personal GUI may generally provide a list of available fitness classes (including individual exercises) a user may select. Various types of content may be included, such as live streams, recorded video content, and/or customized fitness classes. The content may be arranged such that pertinent information for each class is displayed to the user including, but not limited to the class name, instructor name, duration, skill level, date and time (especially if a live stream), user ratings, and a picture of the instructor and/or a representative image of the workout. Once a particular fitness class is selected, additional information on the class may be displayed to the user including, but not limited to the class timeline, the class schedule (e.g., types of exercises), names of other users registered for the class, biometric data of users who previously completed the class, a leaderboard, and user reviews. In some cases, a preview video of the class may be shown to the user either within the list of fitness classes and/or once a particular fitness class is selected.

If the content selected by the user is on-demand, the content may be immediately played on the system 99 or saved for later consumption. If the content is instead a live stream, an integrated calendar in the personal GUI may create an entry indicating the date and time the live fitness class occurs. The calendar may also be configured to include entries for on-demand content may the user wish to play the content at a later date. The personal GUI may show the calendar to provide a summary of reserved fitness classes booked by the user. The calendar may also be used to determine whether a schedule conflict would occur if the user selects a class due to an overlap with another class. The personal GUI may also be linked to a user's third-party calendar (e.g., a Microsoft Outlook calendar, a Google calendar, Fantastical, etc.) to provide integration and ease of scheduling particularly with other appointments in the user's calendar.

The personal GUI may initially list the fitness classes together as a single list. The personal GUI may provide several categories for the user to select in order to narrow the listing of classes. The personal GUI may also include one or more filters to help a user narrow down a selected listing of fitness classes to better match the user's preferences. The filter may be based on various attributes of the user and/or the fitness class including, but not limited to the exercise type, duration, skill level, instructor name, number of registered users, number of openings available, an average user score based on registered users and previous users who completed the class, injury, location, age, weight, demographic, height, gender, user rating, popularity, date and time, and scheduling availability.

The personal GUI may also be configured to provide a listing of the fitness classes the user previously attended. This listing may be further subdivided between fully completed fitness classes and partially completed fitness classes in case the user wishes to repeat or finish a fitness class. The personal GUI may also provide a listing of the fitness classes that the user has designated as favorites. Generally, a fitness class may be favorited before, during, or after the class by selecting an interactive element configured to designate the content as the user's favorite. The personal GUI may also provide a listing of featured fitness classes to the user. A fitness class may be featured under various conditions including, but not limited to being selected by a moderator or editor, the popularity (e.g., the number of hits for a certain period of time), and the user rating.

Fitness classes may also be recommended to the user. A listing of recommended fitness classes may be generated using a combination of the user's profile and their social network. For example, recommendations may be based on various attributes including, but not limited to the user's age, weight, height, gender, workout history, ratings, favorited classes, group membership, contact lists, skill level, workout performance, recommendations from other users and/or instructors, and other users that are being followed via the social network component. The recommendations may be updated and further refined based on feedback provided by the user. For example, an initial listing of recommended fitness classes may be shown to the user. The user may then select a subset of the classes that match the user's interest (or don't match the user's interest). Based on the selection, an updated listing of recommended fitness classes may be presented to the user that more closely match the selected classes.

The personal GUI filters may include workout skill level, duration, instructor, and exercise type. Once a particular class is selected, the personal GUI may present additional information for the class. For example. a brief description of the fitness class may be provided. Additionally, biometric data of the user and/or other previous users attending the class may be displayed to the user to provide an indication of the workout intensity. The personal GUI may also include interactive elements to start and/or resume the fitness class (e.g., in the event the user previously started the class, but did not finish).

The personal GUI may also provide the ability to generate customized fitness classes designed to better match user preferences. A customized fitness class may be constructed from individual exercises extracted from multiple fitness classes. The type of exercises included may depend on various user information including, but not limited to the user's fitness goals, age, weight, skill level, biometric data, past performance, and the types of exercise chosen by the user (e.g., fitness boxing, boxing padwork, cardio, strength, stretching, yoga exercises). Each exercise may also be modified according to various aspects including, but not limited to the duration, the number of repetitions, and the exercise conditions. Additionally, the order of the exercises may be arranged based on the desired pace of the workout. For example, a higher intensity workout may place more difficult exercises together within the workout. A lower intensity workout may include more rest breaks distributed throughout the workout. The total duration of the customized workout may also depend on user preferences including, but not limited to a user-defined duration, the number of calories the user wishes to burn, and biometric data to determine a preferred duration for the user to meet their fitness goal while reducing the risk of injury (e.g., due to overexertion, dehydration, muscle strain).

Once the user selects the fitness class and the class begins, the personal GUI may be configured to display various information and/or controls to the user. As described above, the system 99 is used primarily to show video content via the surface of the punching bag 10 and audio outputs via the speakers. In some cases, the punching bag 10 or wall 30 may also be configured to show GUI-related features of the personal GUI. The portion of the personal GUI with control inputs may instead be shown on the user's smart device. Therefore, the personal GUI, as described herein, may be split between the system 99 and another device. Of course, the system 99 may be configured to be used without the aid of another device as described above. In such cases, the information and control inputs provided by the GUI may be displayed entirely on the punching bag 10, wall 30, or the user's device, such as, for example, a smart phone.

For example, the personal GUI on a user's smart phone may give the user the ability to play, pause, rewind, fast forward, or skip certain portions of the workout. The personal GUI may also include controls for the user to adjust the volume of the output sound (e.g., from the system 99 or a Bluetooth speaker) and to rate the exercise and/or fitness class. The personal GUI may also display the current exercise, the skill level, the instructor name, and the duration of the routine. A workout log may be accessed before, during, or after the workout. The workout log may contain various information including the total calories burned, the total number of workouts, the total duration the user was exercising, the user's progress in meeting a fitness goal (e.g., a weekly goal), and the number of workouts completed relative to the number of workouts to meet the weekly goal.

As described above, the system 99 may also show various GUI-related features during the workout. For example, an overview of the fitness class prior to the start of the workout could be shown including a video of the instructor, instructor name, skill level, duration, name of the class, brief summary of the class, and timeline. The timeline may be used to indicate the pace and/or intensity level of class. For example, a timeline could indicate multiple periods corresponding to a higher intensity workout. In some cases, the timeline may be displayed throughout the workout on the system 99 and/or the user's smart device. The timeline may also be interactive (on either the system 99 via a touch command or the user's smart device) to allow the user to select and jump to different sections of the class.

Once a class begins, various GUI-related features may be shown to indicate the status and progress of the user's workout in conjunction with the video content. The GUI formed by the dynamic content and the sensors 410 may include a timer indicating the amount of time passed and a progress bar (e.g., represented as a circle around the timer) to show the user's progress for a particular exercise. Depending on the exercise, a counter may instead be shown to represent the number of repetitions for the exercise. The GUI could also display the name of the exercise and the number of users actively participating in the same fitness class. The GUI may also show the next exercise in the workout. If the user is wearing a biometric sensor, such as a heart rate (HR) monitor, the GUI may also display real-time biometric data, such as the user's heart rate. Additional information derived from the biometric data may also be displayed, such as the number calories burned based on the user's heart rate. In some cases, the video content may be augmented by additional notes from the instructor. For example, the GUI could display the instructor performing the exercise and a miniaturized representation of the instructor performing the same exercise using an alternative form and/or movement. The alternative form may present a more challenging version of the exercise to the user.

In some cases, the system 99 may actively monitor the user's biometric data to provide additional guidance to the user. For example, the system 99 may display a message indicating the user's heart rate has dropped below a desired threshold. Thus, the system 99 may indicate to the user to increase their intensity in order to increase their heart rate. In another example, the system 99 may inform the user the exercise is modified to accommodate a user's injury and/or to reduce the risk of injury. In other cases, the GUI may provide a message containing other information derived from the biometric data including, but not limited to the user's heart rate relative to a target heart rate zone, the number of steps relative to a target number of steps, the user's perspiration rate, the user's breathing rate, and the extent to which the user is able to properly emulate the form and movement of a particular exercise (e.g., qualified using feedback such as 'poor', 'good', 'great').

The system 99 may also show avatars corresponding to for example a portion of the other users attending the same fitness class. The avatar may be an image of each user, an icon, or a graphic. For example, the system 99 may acquire an image of the user to display as an avatar during the initial creation of the user's account. The image may be modified or replaced thereafter. Additional information from other users may also be shown including, but not limited to the other users' scores during the workout, skill level(s), and biometric data (e.g., heart rate, heart rate relative to a target heart rate zone, step count).

Once the workout is complete, the GUI and/or the personal GUI may display a summary of the workout and a weekly exercise log. For example, the workout log could show on the system 99 as previously described with reference to the personal GUI. The GUI may provide the user's score, the user's performance statistics, the user's average heart rate, the number of calories burned, and a chart showing the change in the user's heart rate during the workout. The GUI may also show the days of the week the user met their daily exercise goals.

In some cases, the user may receive achievements during or after the workout. These achievements may be awarded when the user satisfies certain criteria. The achievements may also be shared with other users in the fitness class immediately after receipt or after the workout is complete. Similarly, the user may see another user's achievements during or after the workout. The display of achievements may be toggled on or off in the settings depending on user preferences.

The various GUI-related features shown on the system 99 may be toggled on or off via the settings GUI. The layout, color, and size of these GUI-features may also be customizable. For example, the user may wish to show as little information as possible (e.g., only the timer, exercise type, and the progress bar) such that the video content and the user's reflection appear less cluttered and/or less obstructed during the workout.

Computing Unit

With reference to FIG. 17, there is shown a schematic diagram of the computing unit 105 in accordance with non-limiting implementations of the present technology. In some implementations, the computing unit 105 may be implemented by any of a conventional personal computer, a controller, and/or an electronic device (e.g., a server, a controller unit, a control device, a monitoring device etc.) and/or any combination thereof appropriate to the relevant task at hand. In some implementations, the computing unit 105 includes various hardware components including one or more single or multi-core processors collectively represented by a processor 120, a solid-state drive 130, a RAM 140, a dedicated memory 150 and an input/output interface 160. The computing unit 105 may be a generic computer system.

In some other implementations, the computing unit 105 may be an "off the shelf" generic computer system. In some implementations, the computing unit 105 may also be distributed amongst multiple systems. The computing unit 105 may also be specifically dedicated to the implementation of the present technology. As a person in the art of the present technology may appreciate, multiple variations as to how the computing unit 105 is implemented may be envisioned without departing from the scope of the present technology.

Communication between the various components of the computing unit 105 may be enabled by one or more internal and/or external buses 180 (e.g. a PCI bus, universal serial bus, IEEE 1394 "Firewire" bus, SCSI bus, Serial-ATA bus, ARINC bus, etc.), to which the various hardware components are electronically coupled.

The input/output interface 160 may provide networking capabilities such as wired or wireless access. As an example, the input/output interface 160 may include a networking interface such as, but not limited to, one or more network ports, one or more network sockets, one or more network interface controllers and the like. Multiple examples of how the networking interface may be implemented will become apparent to the person skilled in the art of the present technology. For example, but without being limitative, the networking interface may implement specific physical layer and data link layer standard such as Ethernet, Fibre Channel, Wi-Fi or Token Ring. The specific physical layer and the data link layer may provide a base for a full network protocol stack, allowing communication among small groups of computers on the same local area network (LAN) and large-scale network communications through routable protocols, such as Internet Protocol (IP).

According to implementations of the present technology, the solid-state drive 130 stores program instructions suitable for being loaded into the RAM 140 and executed by the processor 120. Although illustrated as a solid-state drive 130, any type of memory may be used in place of the solid-state drive 130, such as a hard disk, optical disk, and/or removable storage media.

The processor 120 may be a general-purpose processor, such as a central processing unit (CPU) or a processor dedicated to a specific purpose, such as a digital signal processor (DSP). In some implementations, the processor 120 may also rely on an accelerator 170 dedicated to certain given tasks. In some implementations, the processor 120 or the accelerator 170 may be implemented as one or more field programmable gate arrays (FPGAs). Moreover, explicit use of the term "processor", should not be construed to refer exclusively to hardware capable of executing software, and may implicitly include, without limitation, application specific integrated circuit (ASIC), read-only memory (ROM) for storing software, RAM, and non-volatile storage. Other hardware, conventional and/or custom, may also be included.

Further, the computing unit 105 may include a Human-Machine Interface (HMI) 106. In this implementation, the display of the HMI 106 includes and/or be housed with a touchscreen to permit users to input data via some combination of virtual keyboards, icons, menus, or other Graphical User Interfaces (GUIs). The HMI 106 may thus be referred to as a user interface 106. In some implementations, the display of the user interface 106 may be implemented using a Liquid Crystal Display (LCD) display or a Light Emitting Diode (LED) display, such as an Organic LED (OLED) display. The device may be, for example and without being limitative, a handheld computer, a personal digital assistant. a cellular phone, a network device, a smartphone, a navigation device, an e-mail device, a game console, or a combination of two or more of these data processing devices or other data processing devices. The user interface 106 may be embedded in the computing unit 105 as in the illustrated implementation of FIG. 2 or located in an external physical location accessible to the user. For example, the user may communicate with the computing unit 105 (i.e. send instructions thereto and receive information therefrom) by using the user interface 106 wirelessly connected to the computing unit 105. The computing unit 105 may be communicate with the user interface 106 via a network (not shown) such as a Local Area Network (LAN) and/or a wireless connexion such as a Wireless Local Area Network (WLAN).

The computing unit 105 may include a memory 102 communicably connected to the computing unit 105. The memory 102 may be embedded in the computing unit 105 as in the illustrated implementation of FIG. 2 or located in an external physical location. The computing unit 105 may be configured to access a content of the memory 102 via a network (not shown) such as a Local Area Network (LAN) and/or a wireless connexion such as a Wireless Local Area Network (WLAN).

The computing unit 105 may also include a power system (not depicted) for powering the various components. The power system may include a power management system, one or more power sources (e.g., battery, alternating current (AC)), a recharging system, a power failure detection circuit, a power converter or inverter and any other components associated with the generation, management and distribution of power in mobile or non-mobile devices.

It should be noted that the computing unit 105 may be implemented as a conventional computer server or cloud-based (or on-demand) environment. Needless to say, the computing unit 105 may be implemented in any other suitable hardware, software, and/or firmware, or a combination thereof. In the depicted non-limiting implementations of the present technology in FIG. 2, the computing unit 105 is a single server. In alternative non-limiting implementations of the present technology, the functionality of the computing unit 105 may be distributed and may be implemented via multiple servers.

Those skilled in the art will appreciate that processor 120 is generally representative of a processing capability that may be provided by, for example, a Central Processing Unit (CPU). In some implementations, in place of or in addition to one or more conventional CPUs, one or more specialized processing cores may be provided. For example, one or more Graphic Processing Units (GPUs), Tensor Processing Units (TPUs), accelerated processors (or processing accelerators) and/or any other processing unit suitable for training and executing an MLM may be provided in addition to or in place of one or more CPUs. In this implementation, the processor 120 of the computing unit 105 is a Graphical Processing Unit (GPU) and the dedicated memory 150 is a Video Random access Memory (VRAM) of the processing unit 120. In alternative implementations, the dedicated memory 150 may be a Random Access Memory (RAM), a Video Random Access Memory (VRAM), a Window Random Access Memory (WRAM), a Multibank Dynamic Random Access Memory (MDRAM), a Double Data Rate (DDR) memory, a Graphics Double Data Rate (GDDR) memory, a High Bandwidth Memory (HBM), a Fast-Cycle Random-Access Memory (FCRAM) or any other suitable type of computer memory.

The computing unit 105 also includes the database 102 that may be used, for example, for storing the generated exercise performance metrics of the user 88, linear content (e.g. pre-recorder videos or images), reference distance measurements, information about the critical portion 750 or any other relevant information.

In this implementation, the computing unit 105 is coupled to various devices such as the CDN 123, the biometric sensor and the user device 101 over the communication network 122. It is contemplated that the CDN 123, the biometric sensor and the user device 101 may be communicably connected to the computing unit 105 using distinct communication network instead of the same communication network 122. It is also contemplated that the computing unit with 105 may be communicably connected to a plurality of user devices and/or a plurality of biometric sensors simultaneously.

CONCLUSION

All parameters, dimensions, materials, and configurations described herein are meant to be presented as examples and the actual parameters, dimensions, materials, and/or configurations may depend upon the specific application or applications for which the teachings is/are used. It is to be understood that the foregoing implementations are presented primarily by way of example and that, within the scope of the appended claims and equivalents thereto, implementations may be practiced otherwise than as specifically described and claimed. Disclosed implementations of the present disclosure are directed to each individual feature, system 99, article, material, kit, and/or method described herein.

In addition, any combination of two or more such features, system 99, articles, materials, kits, and/or methods, if such features, system 99, articles, materials, kits, and/or methods are not mutually inconsistent, is included within the scope of the present disclosure. Other substitutions, modifications, changes, and omissions may be made in the design, operating conditions and arrangement of respective elements of the example implementations without departing from the scope of the present disclosure. The use of a numerical range does not preclude equivalents that fall outside the range that fulfill the same function, in the same way, to produce the same result.

The above-described implementations may be implemented in multiple ways. For example, implementations may be implemented using hardware, software or a combination thereof. When implemented in software, the software code may be executed on a suitable processor or collection of processors, whether provided in a single computer or distributed among multiple computers.

Further, a computer may be embodied in any of a number of forms, such as a rack-mounted computer, a desktop computer, a laptop computer, an embedded computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices may be used, among other things, to present a user interface. Examples of output devices that may be used to provide a user interface include printers or display screens for visual presentation of output and speakers or other sound generating devices for audible presentation of output. Examples of input devices that may be used for a user interface include keyboards, and pointing devices, such as mice, touch pads, and digitizing tablets. As another example, a computer may receive input information through speech recognition or in other audible format. As well, a hand touch, or boxing glove covered hand touch onto a surface, especially the punching bag 10 and the wall 30 referred to herein above, may be considered a computer receiving an information input.

Such computers may be interconnected by one or more networks in a suitable form, including a local area network or a wide area network, such as an enterprise network, an intelligent network (IN) or the Internet. Such networks may be based on a suitable technology, may operate according to a suitable protocol, and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. Some implementations may specifically employ one or more of a particular operating system or platform and a particular programming language and/or scripting tool to facilitate execution.

Also, various disclosed concepts may be embodied as one or more methods, of which for example one example bas been provided. The acts performed as part of the method may in some instances be ordered in different ways. Accordingly, in some disclosed implementations, respective acts of a given method may be performed in an order different than specifically illustrated, which may include performing some acts simultaneously (even if such acts are shown as sequential acts in illustrative implementations).

All publications, patent applications, patents, and other references mentioned herein are incorporated by reference in their entirety.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising"

may refer, in one implementation, to A only (optionally including elements other than B); in another implementation, to B only (optionally including elements other than A); in yet another implementation, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") may refer, in one implementation, to at least one, optionally including more than one, A, with no B present (and optionally including elements other than B); in another implementation, to at least one, optionally including more than one, B, with no A present (and optionally including elements other than A); in yet another implementation, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to.

It will also be appreciated by persons of ordinary skill in the art that the technology is not limited to what has been particularly shown and described hereinabove. For example, the use of high density conventional polyurethane foam could be replaced by a compatible material or combination of other materials. And, for example, drawings or illustrations may not show every connection, mechanical and/or electrical, between various drawn elements, in so far at least for clarity in illustration.

There are many options and engineering considerations to construct specific versions of the system 99 utilizing the techniques presented herein as those in the art could apply. Rather, the scope of the technology includes combinations and sub-combinations of the various features described hereinabove as well as modifications and variations which would occur to such skilled persons upon reading the foregoing description.

It should be expressly understood that not all technical effects mentioned herein need to be enjoyed in each and every implementation of the present technology.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A system for providing a fitness experience to a user, the system comprising:

a punching bag defining an outer non-planar surface adapted to receive strikes of the user;

a sensor configured to generate data about the strikes applied by the user on the punching bag;

a wall-mounting frame that supports the punching bag;

an image projecting device configured to project a dynamic content on the outer non-planar surface of the punching bag; and a processor communicably connected to the sensor and the image projecting device, the processor being configured to:

dynamically adjust the dynamic content projected on the outer non-planar surface based at least in part on the data provided by the sensor.

2. The system of claim 1, wherein the data about the strikes applied by the user is a first data, the sensor being further configured to generate second data about a movement of the user in a pre-determined area in a vicinity of the punching bag.

3. The system of claim 2, wherein the sensor comprises:

at least one striking sensor configured to generate the first data; and at least one motion tracking sensor configured to generate the second data.

4. The system of claim 3, wherein the at least one striking sensor is selected among a group of striking sensors comprising: distance sensors, multizone distance sensors, 2D imagers, and 3D imagers.

5. The system of claim 1, wherein the processor is configured to perform an image distortion correction on the projected dynamic content to compensate for physical distortion induced by the outer non-planar surface of the punching bag.

6. The system of claim 5, wherein the processor performs the image distortion correction by applying a geometric image transformation to the dynamic content.

7. The system of claim 1, wherein the image projecting device comprises an ultra-short-throw projector.

8. The system of claim 1, wherein the sensor comprises force sensors configured to generate data about force of the strikes of the user by tracking displacement of the punching bag relative to a wall.

9. The system of claim 1, wherein:

the dynamic content comprises an interactive content projected onto the outer non-planar surface of the punching bag; and the sensor is further configured to detect interactions of the user with the interactive content when the user enters a vicinity of the interactive content and/or applies a pressure on the outer non-planar surface of the punching bag at a location of the interactive content.

10. The system of claim 9, wherein the interactive content forms a graphical user-interface configured for physical interaction with the user.

11. The system of claim 9, wherein the interactive content is configured to be interacted with using fighting gloves.

12. The system of claim 1, wherein the processor is further configured to generate exercise performance metrics for the user based on the data provided by the sensor.

13. The system of claim 12, wherein the processor is further configured to:

store the generated exercise performance metrics onto a memory communicably connected to the processor; and dynamically adjust the dynamic content projected on the outer non-planar surface based on the exercise performance metrics of the user.

14. The system of claim 1, wherein the punching bag comprises a plurality of layers, the sensor being disposed between two adjacent ones of the plurality of layers.

15. The system of claim 1, wherein the wall-mounting frame further supports the image projecting device substantially above the punching bag.

16. The system of claim 1, further comprising a vibration-absorption module disposed between the punching bag and a wall.

17. The system of claim 1, wherein the fitness experience is a boxing training experience and the dynamic content is a boxing-related content.

18. The system of claim 1, wherein the dynamic content comprises one or more of:

a fitness class content, a technical class content, a gaming multiplayer offline and/or online content, a sparring offline and online content, and an Artificial Intelligence-driven coaching content.

19. The system of claim 1, further comprising a networking device communicably connected to at least one of:

a content delivery network (CDN) for receiving at least a portion of the dynamic content from the CDN; or one or more social network platforms for receiving data therefrom and transmitting data thereto.

20. The system of claim 1, further comprising a lighting measurement device communicably connected to the processor and configured to determine ambient light conditions around the punching bag, the processor further adapting a level of brightness and/or a color temperature of the dynamic content projected by the image projecting device.

21. The system of claim 1, further comprising an array of light emitting devices disposed on an outer edge of the punching bag.

22. The system of claim 21, wherein the array of light emitting devices is communicably connected to the processor, the processor being further configured to cause the array of light emitting devices to provide varying ambient light conditions based on data provided by at least one of:

the sensor;

the dynamic content currently projected onto the outer non-planar surface of the punching bag; or a lighting measurement device communicably connected to the processor and configured to determine ambient light conditions around the punching bag.

23. The system of claim 1, wherein at least a portion of the dynamic content is projected on a wall in a vicinity of the punching bag.

24. The system of claim 1, wherein the sensor comprises one or more of:

an accelerometer sensor;

an infrared sensor;

an ultrasonic sensor;

a laser-ranging sensor;

a time-of-flight sensor;

a time-of-flight multizone sensor;

a Millimeter-wave radar;

a Red-Green-Blue (RGB) camera;

a monochromatic camera;

an optical-flow smart camera;

a structured-light depth sensor;

a 3D time-of-flight depth sensor;

a stereoscopic depth camera; or a LiDAR depth sensor.

25. The system of claim 1, wherein the outer non-planar surface has a half-cylinder elliptical shape.

26. The system of claim 1, wherein the dynamic content forms a human-size representation of a coach or a sparring partner.

27. The system of claim 1, wherein:

the punching bag defines a critical portion on the outer non-planar surface and a critical corresponding 3D zone of interest; and the sensor has a corresponding field-of-view, the sensor being configured to generate data about strikes occurring in the corresponding field-of-view, the sensor being disposed relatively to the outer non-planar surface such that the corresponding field-of-view covers the critical portion and the corresponding critical 3D zone of interest.

28. The system of claim 27, wherein the sensor comprises a plurality of sensors, each sensor having a corresponding field-of-view, the plurality of sensors being disposed such that a first field-of-view of a first sensor and a second field-of-view of a second sensor overlap one another on the critical portion of the outer non-planar surface and the critical 3D zone of interest.

29. The system of claim 28, wherein setting characteristics of the plurality of sensors are determined based on:

an input precision criterion indicative of a maximal distance between an estimated position of a strike determined by the plurality of sensors and an actual position of the strike on the critical corresponding 3D zone of interest;

a 3D geometry of the outer non-planar surface; and electromechanical properties of the plurality of sensors.

30. The system of claim 1, wherein the sensor is configured to generate data comprising information about at least one of:

a location of a strike on the outer non-planar surface of the punching bag;

a speed of the strike;

an acceleration of the strike;

a trajectory of the strike; or a force of the strike.

* * * * *